US006253158B1

(12) United States Patent
Nakajima et al.

(10) Patent No.: US 6,253,158 B1
(45) Date of Patent: Jun. 26, 2001

(54) METHOD OF JUDGING TRUTH OF PAPER TYPE AND METHOD OF JUDGING DIRECTION IN WHICH PAPER TYPE IS FED

(75) Inventors: Hideki Nakajima, Daito; Hidetaka Sakai, Higashiosaka; Hiroshi Tatsumi, Osaka, all of (JP)

(73) Assignee: Sanyo Electric Co., LTD, Osaka (JP)

( * ) Notice: Subject to any disclaimer, the term of this patent is extended or adjusted under 35 U.S.C. 154(b) by 0 days.

(21) Appl. No.: 09/672,854

(22) Filed: Sep. 29, 2000

Related U.S. Application Data

(62) Division of application No. 09/101,299, filed as application No. PCT/JP97/00131 on Jan. 22, 1997.

(30) Foreign Application Priority Data

| | | |
|---|---|---|
| Jan. 25, 1996 | (JP) | 8-010919 |
| Jan. 26, 1996 | (JP) | 8-011720 |
| Mar. 8, 1996 | (JP) | 8-052117 |
| Mar. 13, 1996 | (JP) | 8-056071 |
| Aug. 29, 1996 | (JP) | 8-228579 |
| Aug. 29, 1996 | (JP) | 8-228580 |

(51) Int. Cl.[7] ..... G07D 7/00

(52) U.S. Cl. ..... 702/71; 702/82; 271/227; 271/256; 250/548; 382/112

(58) Field of Search ..... 702/71, 82, 170; 271/227, 256, 261, 274; 73/618, 599; 356/386, 383, 381; 382/112, 158; 250/548, 559.36

(56) References Cited

U.S. PATENT DOCUMENTS

| | | | | |
|---|---|---|---|---|
| 5,055,834 | * | 10/1991 | Chiba | 340/825.34 |
| 5,729,623 | * | 3/1998 | Omatu et al. | 382/155 |
| 6,157,895 | * | 12/2000 | Nakajima et al. | 702/82 |

* cited by examiner

*Primary Examiner*—Kamini Shah
(74) *Attorney, Agent, or Firm*—Arent Fox Kintner Plotkin & Kahn, PLLC

(57) ABSTRACT

Random components for each characteristic amount of a paper type to be examined are extracted on the basis of characteristic amounts of the paper type which are read from a plurality of portions on the paper type and reference data previously found with respect to the plurality of portions. Dirt components for each of the plurality of portions on the paper type to be examined are presumed on the basis of the extracted random components for each characteristic amount and a predetermined forecast model of the dirt components. The truth of the paper type to be examined is judged on the basis of the presumed dirt components and the extracted random components.

5 Claims, 22 Drawing Sheets

METHOD OF JUDGING TRUTH OF PAPER TYPE AND METHOD OF JUDGING DIRECTION IN WHICH PAPER TYPE IS FED

This application is a divisional application filed of patent application Ser. No. 09/101,299, filed Jul. 8, 1998 which is a national stage of PCT/JP97/00131 filed Jan. 22, 1997.

TECHNICAL FIELD

The present invention relates to a method of judging the truth of a paper type such as a bill or securities, a method of judging the direction in which a paper type is fed, and a method of calculating the width of shift of a waveform representing a characteristic amount of a paper type.

BACKGROUND ART

As a method of judging the truth of a bill, a method disclosed in Japanese Patent Publication No. 215293/1985 has been known. In this method, a bill is divided into a plurality of regions. Detection data is obtained by a magnetic sensor for each region of a bill to be examined. The ratio of the detection data in each of the regions to the sum of the detection data in all the regions is calculated for each region. The ratio calculated for each region is compared with a reference value previously found for the region. If the difference therebetween is not within a predetermined allowable range in any one of the regions, it is judged that the bill is a false bill.

If the difference therebetween is within a predetermined allowable range in all the regions, the sum of the differences between the ratios calculated for the respective regions and the reference values in the corresponding regions is calculated. If the calculated sum is not less than a predetermined allowable value, it is judged that the bill is a false bill. If the calculated sum is less than the predetermined allowable value, it is judged that the bill is a true bill.

In the above-mentioned prior art, the ratio of the detection data in each of the regions to the sum of the detection data in all the regions is compared with the reference value previously found for the region. In cases such as a case where the bill is uniformly dirty, therefore, the method of judging the truth of a bill in the prior art is not easily affected by the dirt. However, the dirt of the bill is not generally uniform in respective portions of the bill. In the above-mentioned prior art, erroneous judgment may be made by the dirt, the wrinkle and the like of the bill.

An object of the present invention is to provide a method of judging the truth of a paper type, wherein the truth of a paper type can be judged with high precision without being affected by the dirt, the wrinkle and the like of the paper type.

Another object of the present invention is to provide a method of judging the directing in which a paper type is fed, wherein the direction in which a paper type is fed can be judged with high precision.

Still another object of the present invention is to provide a method of calculating the width of shift of a waveform representing a characteristic amount of a paper type, wherein the width of shift in the direction of conveyance of a waveform representing a characteristic amount of a paper type from a reference waveform can be accurately calculated.

DISCLOSURE OF INVENTION

A first method of judging the truth of a paper type according to the present invention is characterized by comprising the steps of performing first truth judgment processing with respect to a paper type to be examined, performing second truth judgment processing with respect to the paper type to be examined only when it is judged that the paper type to be examined is not a false paper type in the first truth judgment processing, and judging that the paper type to be examined is a true paper type only when it is judged that the paper type to be examined is not a false paper type in the second truth judgment processing, the first truth judgment processing comprising a first step of extracting, on the basis of characteristic amounts of the paper type to be examined which are read from a plurality of portions on the paper type and reference data previously found with respect to the plurality of portions, random components for each of the characteristic amounts of the paper type, a second step of presuming, on the basis of the extracted random components for each of the characteristic amounts and a predetermined forecast model of dirt components, the dirt components for the plurality of portions on the paper type to be examined, and a third step of judging the truth of the paper type to be examined on the basis of the presumed dirt components and the extracted random components, the second truth judgment processing comprising a fourth step of previously selecting from the characteristic amounts of the paper type to be examined which are read from the plurality of portions on the paper type and second reference data previously found with respect to the plurality of portions the characteristic amounts and the second reference data with respect to the plurality of positions where an operation is to be executed as ones suitable for judgment and calculating the goodness of fit of the characteristic amount and the second reference data, and a fifth step of judging the truth of the paper type to be examined on the basis of the calculated goodness of fit.

The reference data used in the first step is generated on the basis of characteristic amounts of a plurality of true paper types which are read from a plurality of portions on the true paper types, for example. Further, the forecast model of the dirt components used in the second step is generated on the basis of the characteristic amounts of the plurality of true paper types which are read from the plurality of portions on the true paper types and the reference data, for example.

An example of the third step is one comprising the step of calculating of a value relating to a prediction error on the basis of the presumed dirt components and the extracted random components, and the step of judging that the paper type to be examined is a false paper type when the calculated value relating to the prediction error is more than a threshold, while judging that the paper type to be examined is not a false paper type when the calculated value relating to the prediction error is not more than the threshold.

The plurality of positions where an operation is to be executed which are used in the fourth step are found by optimization processing using a genetic algorithm, for example.

A second method of judging the truth of a paper type according to the present invention is characterized by comprising a first step of extracting, on the basis of characteristic amounts of a paper type to be examined which are read from a plurality of portions on the paper type and reference data previously found with respect to the plurality of portions, random components for each of the characteristic amounts of the paper type, a second step of presuming, on the basis of the extracted random components for each of the characteristic amounts and a predetermined forecast model of dirt components, the dirt components for the plurality of portions on the paper type to be examined, and a third step of judging the truth of the paper type to be examined on the basis of the presumed dirt components and the extracted random components.

The reference data used in the first step is generated on the basis of characteristic amounts of a plurality of true paper types which are read from a plurality of portions on the true paper types, for example. Further, the forecast model of the dirt components used in the second step is generated on the basis of the characteristic amounts of the plurality of true paper types which are read from the plurality of portions on the true paper types and the reference data, for example.

An example of the third step is one comprising the step of calculating a value relating to a prediction error on the basis of the presumed dirt components and the extracted random components, and the step of judging that the paper type to be examined is a false paper type when the calculated value relating to the prediction error is more than a threshold, while judging that the paper type to be examined is not a false paper type when the calculated value relating to the prediction error is not more than the threshold.

An example of the forecast model of the dirt components is an autoregressive model in which data representing the differences between the characteristic amounts of the plurality of true paper types which are read from the plurality of portions on the true paper types and data representing corresponding portions in the reference data are found from a group of data arranged in a time series.

A third method of judging the truth of a paper type according to the present invention is characterized by comprising the steps of previously selecting from the characteristic amounts of the paper type to be examined which are read from the plurality of portions on the paper type and second reference data previously found with respect to the plurality of portions the characteristic amounts and the second reference data with respect to a plurality of positions where an operation is to be executed as one suitable for judgment and calculating the goodness of fit of the characteristic amount and the second reference data, and judging the truth of the paper type to be examined on the basis of the calculated goodness of fit.

The plurality of positions where an operation is to be executed are selected by optimization processing using a genetic algorithm, for example.

An example of the optimization processing using the genetic algorithm is one comprising a first step of producing an initial population comprising a first predetermined number of individuals each having as genes a plurality of predetermined positions where characteristic amounts are read, each of the genes taking a value indicating whether or not the position for reading is taken as an object to be operated, a second step of calculating for each of the individuals an evaluated value of precision of distinction between a true paper type and a false paper type on the basis of data for analyzing a plurality of true paper types and a plurality of false paper types which are previously prepared, to select a second predetermined number of individuals each taking a high evaluated value, a third step of selecting an arbitrary pair of individuals from the selected individuals and subjecting the pair of individuals to a predetermined genetic operation, to generate a new population comprising a first predetermined number of individuals by, a fourth step of discarding the individuals each having genes to be operated whose number exceeds a predetermined limited number, a fifth step of producing a population comprising the first predetermined number of individuals each having genes to be operated whose number is not more than the predetermined limited number by repeating a predetermined genetic operation, and a sixth step of repeating the processing in the second step to the fifth step a predetermined number of times.

Examples of the genetic operation include crossing processing and mutation processing.

A method of judging the direction in which a paper type is fed according to the present invention is characterized by comprising a first step of reading, from a plurality of portions of a paper type to be examined which is put into an examining device, characteristic amounts of the paper type, and a second step of judging the direction in which the paper type is fed by comparing the read characteristic amounts and reference data for each direction of feeding which is previously generated for the direction of feeding.

An example of the second step is one comprising the steps of finding for each reference data for each direction of feeding the sum of the squares of the differences between the characteristic amounts read from the plurality of portions of the paper type and data representing corresponding positions in the reference data for the direction of feeding, and judging that the direction of the reference data corresponding to the minimum value out of the obtained values is the direction in which the paper type is fed.

An example of the second step is one comprising the steps of finding the differences between characteristic amounts corresponding to positions represented by the characteristic amounts read from the portions for reading of the paper type to be examined and data representing corresponding positions in the reference data for a predetermined direction of feeding and correcting the characteristic amounts for the portions for reading of the paper type so that the average value of the differences becomes zero, finding for each reference data for each direction of feeding the sum of the squares of the differences between characteristic amounts after the correction corresponding to the plurality of portions of the paper type and data representing corresponding positions of the reference data for the direction of feeding, and judging that the direction of the reference data corresponding to the minimum value out of the obtained values is the direction in which the paper type is fed.

An example of the second step is one comprising the steps of retrieving from a plurality of predetermined portions where characteristic amounts are read a minimum of portions for reading where the rate of correct answers to the results of the judgment of the direction of feeding is not less than a threshold by optimization processing using a genetic algorithm, and judging, on the basis of the characteristic amounts obtained only from the retrieved portions where characteristic amounts are read and reference data for each direction in which an object to be examined is fed which is previously generated for the direction of feeding, the direction in which the object to be examined is fed.

An example of the optimization processing using the genetic algorithm is one comprising a first step of producing an initial population comprising a first predetermined number of individuals each having as genes a plurality of predetermined positions where characteristic amounts are read, each of the genes taking a value indicating whether or not the position where a characteristic amount is read for judging the direction of feeding is taken as an object, a second step of selecting from the initial population a second predetermined number of individuals each having a small number of genes taking as an object the position where a characteristic amount is read for judging the direction of feeding, a third step of selecting an arbitrary pair of individuals from the selected individuals and subjecting the pair of individuals to a predetermined genetic operation, to generate a new population comprising a first predetermined number of individuals, a fourth step of calculating for each individual in the new population the rates of corrected answers to the results of the judgment of the direction of feeding which respectively correspond to a plurality of data for examining constraint conditions obtained from a plurality of data for analysis previously prepared, and discarding the individuals the rates of corrected answers of which are lower than a threshold, a fifth step of repeating the predetermined genetic operation, to produce a population comprising the first predetermined number of individuals the rates of corrected answers of which are not less than the threshold, and a sixth step of repeating the processing in the second step to the fifth step a predetermined number of times.

Examples of the genetic operation include crossing processing and mutation processing.

A method of calculating the width of shift of a waveform representing a characteristic amount of a paper type according to the present invention is characterized by comprising a first step of reading, from a plurality of portions in the direction of conveyance of a paper type to be examined, characteristic amounts of the paper type, to produce an input waveform representing the characteristic amount corresponding to a position in the direction of conveyance of the paper type, a second step of setting a plurality of widths of shift in the direction of conveyance of the input waveform from a reference waveform between a predetermined minimum width of shift and a predetermined maximum width of shift, to produce for each of the set widths of shift a plurality of waveforms for calculating the width of shift which are obtained by shifting the input waveform in the direction of conveyance, a third step of calculating for each of the produced waveforms for calculating the width of shift a value corresponding to the sum of the differences between the waveform for calculating the width of shift and a reference waveform previously produced at a plurality of predetermined positions where an operation is to be executed out of positions in the direction of conveyance, and a fourth step of determining that the width of shift corresponding to the waveform for calculating the width of shift in which the calculated value corresponding to the sum of the differences is the smallest is the width of shift in the direction of conveyance of the input waveform from the reference waveform.

Examples of the value corresponding to the sum of the differences include the sum of the absolute values of the differences or the sum of the squares of the differences.

The plurality of positions where an operation is to be executed which are used in the third step are found in the following manner, for example. That is, a plurality of widths of shift in the direction of conveyance of the input waveform from the reference waveform are set between the predetermined minimum width of shift and the predetermined maximum width of shift. A plurality of waveforms for calculating the positions where an operation to be executed which are obtained by shifting the reference waveform in the direction of conveyance are produced for each of the set widths of shift. The absolute values of the differences from the reference waveform is calculated at the respective positions in the direction of conveyance for each of the produced waveforms for calculating the positions where an operation is to be executed. The minimum value is extracted out of the calculated absolute values of the differences for each of the positions in the direction of conveyance with respect to the position. A predetermined number of positions are selected in descending order of the extracted minimum values out of all the positions.

BEST MODE FOR CARRYING OUT THE INVENTION

Figure 1:
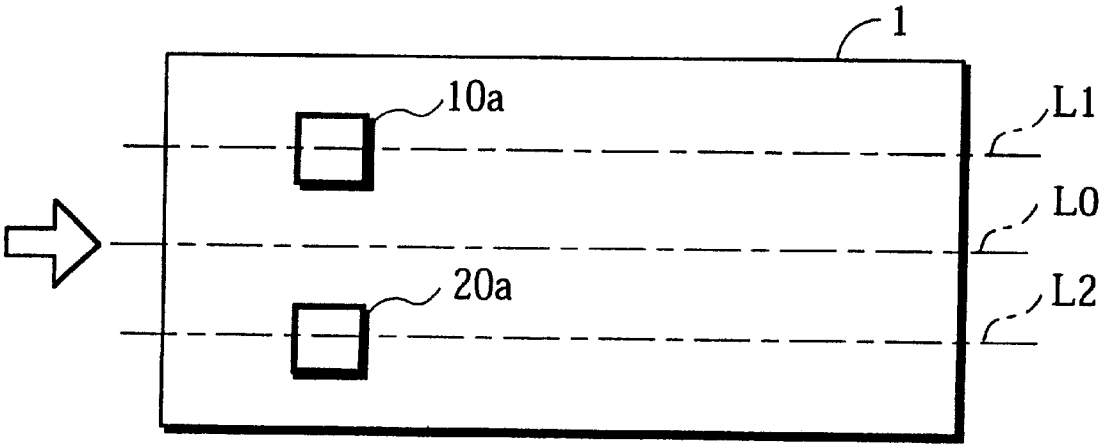
FIG. 1 is a plan view showing the arrangement of a sensor for reading characteristic amounts of a bill.

Referring now to the drawings, embodiments in a case where the present invention is applied to a method of judging the truth of a bill will be described.

[1] Description of Sensor for Reading Characteristic Amounts of Bill

Figure 2:
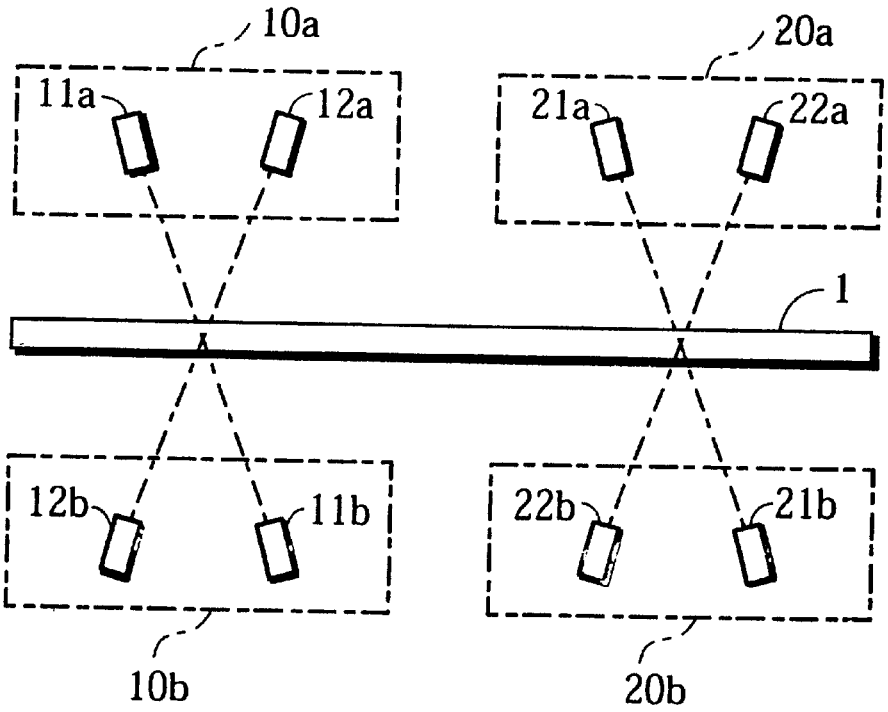
FIG. 2 is a side view as viewed in a direction indicated by an arrow in FIG. 1.

FIGS. 1 and 2 illustrate a sensor for reading characteristic amounts of a bill.

A bill 1 is fed into an examining device (not shown) and is conveyed in a direction indicated by an arrow. As a sensor for reading characteristic amounts of the bill 1, two light projectors 10*a* and 20*a* and two light receivers 10*b* and 20*b* are provided.

The light projector 10*a* comprises a light emitting diode 11*a* for irradiating infrared light having a wavelength λ of 840 nm onto a plurality of positions where the characteristic amounts are read on the surface of the bill 1 and on a line L1 and a light emitting diode 12*a* for irradiating red light having a wavelength of 655 nm onto the positions where the characteristic amounts are read. The light receiver 10*b* comprises a photosensor 11*b* for receiving the infrared light emitted from the light emitting diode 11*a* and passing through the bill 1 and a photosensor 12*b* for receiving the red light emitted from the light emitting diode 12*a* and passing through the bill 1.

The light emitting diode 11*a* and the light emitting diode 12*a* are alternately driven, so that outputs of both the photosensors 11*b* and 12*b* are obtained at the respective positions where the characteristic amounts are read on the line L1 of the bill 1.

The light projector 20*a* comprises a light emitting diode 21*a* for irradiating infrared light having a wavelength λ of 840 nm onto a plurality of positions where the characteristic amounts are read on the surface of the bill 1 and on a line L2 and a light emitting diode 22*a* for irradiating red light having as wavelength λ of 655 nm onto the respective positions where the characteristic amounts are read. The light receiver 20*b* comprises a photosensor 21*b* for receiving the infrared light emitted from the light emitting diode 21*a* and passing through the bill 1 and a photosensor 22*b* for receiving the red light emitted from the light emitting diode 22*a* and passing through the bill 1.

The light emitting diode 21*a* and the light emitting diode 22*a* are alternately driven, so that outputs of both the photosensors 21*b* and 22*b* are obtained at the respective positions where the characteristic amounts are read on the line L2 of the bill 1. The line L1 and the line L2 are at an equal distance from a line L0 passing through the center of the width of the bill 1.

[2] Description of Entire Procedure for Method of Judging Truth of Bill

Figure 3:
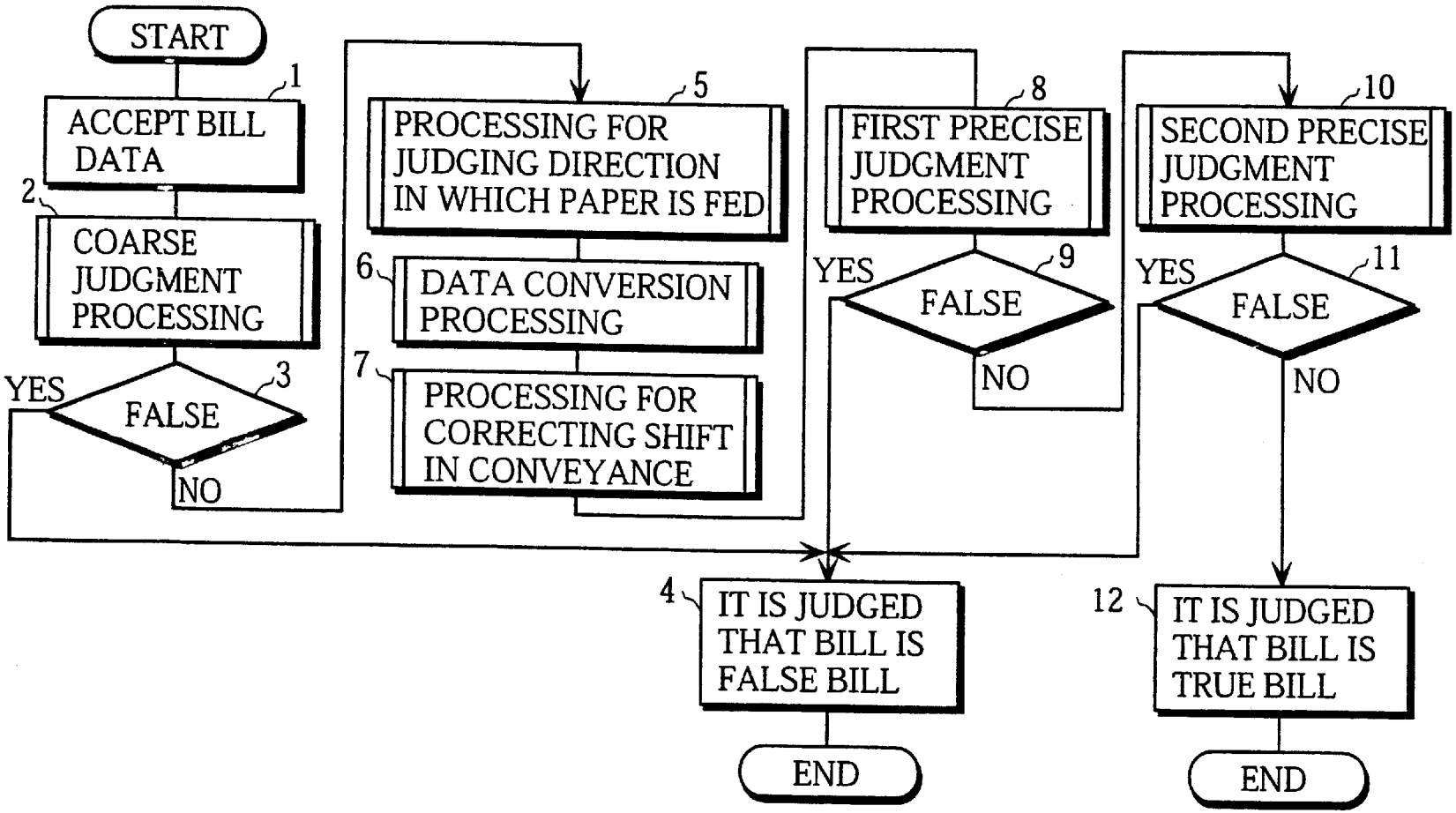
FIG. 3 is a flow chart showing the entire procedure for a method of judging the truth of a bill.

FIG. 3 shows the entire procedure for a method of judging the truth of a bill.

Outputs of the photosensors 11*b*, 12*b*, 21*b* and 22*b* are accepted after being converted into digital signals by an analog-to-digital (A/D) converter (not shown) (step 1).

Coarse judgment processing is then performed on the basis of detected values of the photosensors 11*b*, 12*b*, 21*b* and 22*b* (step 2). When it is judged that the bill is a false bill by the coarse judgment processing (YES in step 3), the result is taken as a final result of judgment (step 4), whereby the current truth judgment processing is terminated.

When it is not judged that the bill is a false bill by the coarse judgment processing (NO in step 3), processing for judging the direction in which the bill is fed is performed on the basis of the detected value of the photosensor 11*b* or 21*b* receiving infrared light (step 5). That is, the number of directions of feeding of the bill is a total of four because it is two in a case where the surface of the bill is directed upward, while being two in a case where the reverse surface of the bill is directed upward. In the processing for judging the direction in which the bill is fed, it is judged which of the four directions is the direction in which the bill is fed.

When the result of the judgment of the direction in which the bill is fed is not a predetermined reference direction of feeding, an input waveform obtained on the basis of the detected value of each of the photosensors 11*b*, 12*b*, 21*b* and 22*b* (a waveform representing a detected value corresponding to a position along the length of the bill) is converted into a waveform obtained in a case where it is assumed that the bill is fed in the predetermined reference direction of feeding (step 6). As a result, two types of input waveforms corresponding to the line L1 and two types of input waveforms corresponding to the line L2 in a case where the bill is fed in the reference direction of feeding are obtained.

The two types of input waveforms corresponding to the line L1 in a case where the bill is fed in the reference direction of feeding include an input waveform based on infrared light and an input waveform based on red light. The two types of input waveforms corresponding to the line L2 in a case where the bill is fed in the reference direction of feeding include an input waveform based on infrared light and an input waveform based on red light.

When the result of the judgment of the direction in which the bill is fed is the predetermined reference direction of feeding, the data conversion processing in the step 6 is not performed.

Thereafter, processing for correcting the shifts in the direction in which the bill is conveyed of the four types of input waveforms corresponding to a case where the direction in which the bill is fed is the reference direction of feeding (processing for correcting the shift in conveyance) is performed (step 7).

First precise judgment processing is performed on the basis of the input waveform based on infrared light corresponding to the line L1 and the input waveform based on infrared light corresponding to the line L2 out of the four types of input waveforms after performing the processing for correcting the shift in conveyance (step 8).

In the first precise judgment processing, the same judgment processing is performed on the basis of the respective input waveforms. In the judgment processing based on at least one of the input waveforms, when it is judged that the bill is a false bill (YES in step 9), the result is taken as a final result of judgment (step 4), whereby the current truth judgment processing is terminated.

When it is not judged that the bill is a false bill by the first precise judgment processing, that is, when it is not judged that the bill is a false bill in the judgment processing performed on the basis of the two input waveforms based on infrared light (No in step 9), second precise judgment processing is performed on the basis of the input waveform based on red light corresponding to the line L1 and the input waveform based on red light corresponding to the line L2 out of the four types of input waveforms after performing the processing for correcting the shift in conveyance (step 10).

In the second precise judgment processing, the same judgment processing is performed on the basis of the respective input waveforms. In the judgment processing based on at least one of the input waveforms, when it is judged that the bill is a false bill (YES in step 11), the result is taken as a final result of judgment (step 4), whereby the current truth judgment processing is terminated.

When it is not judged that the bill is a false bill by the second precise judgment processing, that is, when it is not judged that the bill is a false bill in the judgment processing performed on the basis of the two input waveforms based on red light (NO in step 11), it is judged that the bill is a true bill (step 12), whereby the current truth judgment processing is terminated.

[3] Description of Coarse Judgment Processing

Coarse judgment processing is performed on the basis of detected values of the photosensors 11*b* and 12*b* at a plurality of predetermined positions where characteristic amounts are read on the line L1 of the bill 1 and detected values of the photosensors 21*b* and 22*b* at a plurality of predetermined positions where characteristic amounts are read on the line L2 of the bill 1.

Since the same judgment processing is performed at the respective positions where characteristic amounts are read, description is made of the judgment processing performed at one position where a characteristic amount is read on the line L1 of the bill 1.

Let $v_{11}$ and $v_{12}$ be detected values obtained from the photosensors 11*b* and 12*b* at one position where a characteristic amount is read on the L1 of the bill 1, respectively.

A ratio of the detected values $v_{11}/v_{12}$ and a difference therebetween $(v_{11}-v_{12})$ are first calculated. When the ratio $v_{11}/v_{12}$ is in a first predetermined range, and the difference $(v_{11}-v_{12})$ is in a second predetermined range, it is judged that the bill is a true bill. When the ratio $v_{11}/v_{12}$ is not in the first predetermined range, and the difference $(v_{11}-v_{12})$ is not in the second predetermined range, it is judged that the bill is a false bill.

When it is judged that the bill is a true bill in the judgement processing at all positions where characteristic amounts are read, the answer is in the negative in the step 3 shown in FIG. 3, whereby the program proceeds to the processing for judging the direction in which the bill is fed. When it is judged that the bill is a false bill in the judgment processing at at least one position where a characteristic amount is read, the answer is in the affirmative in the step 3 shown in FIG. 3, whereby the result of the judgment is taken as a final result of the judgment.

[4] Description of Processing for Judging Direction in which Bill is Fed

Figure 4:
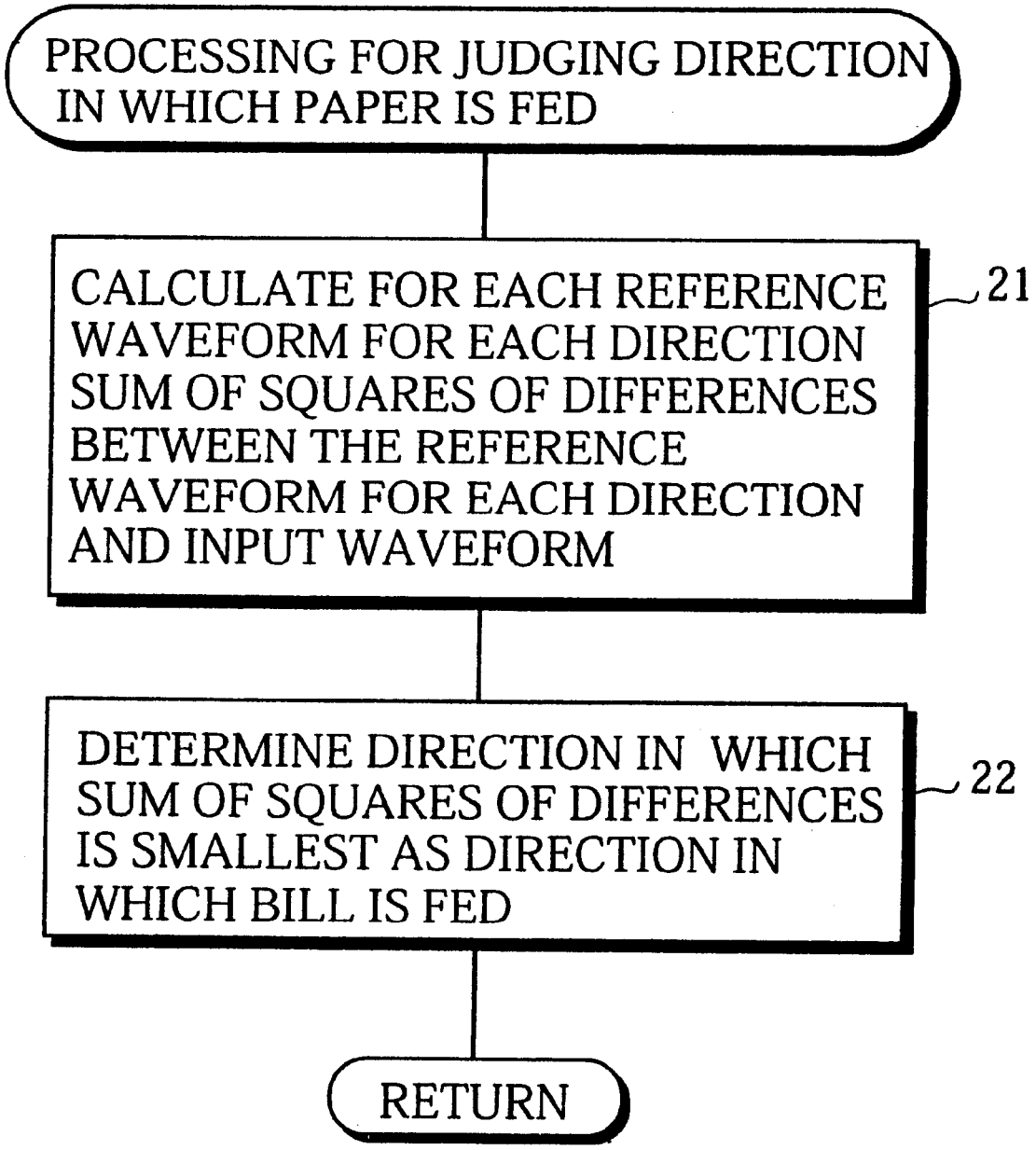
FIG. 4 is a flow chart showing the procedure for processing for judging the direction in which a bill is fed.
Figure 5:
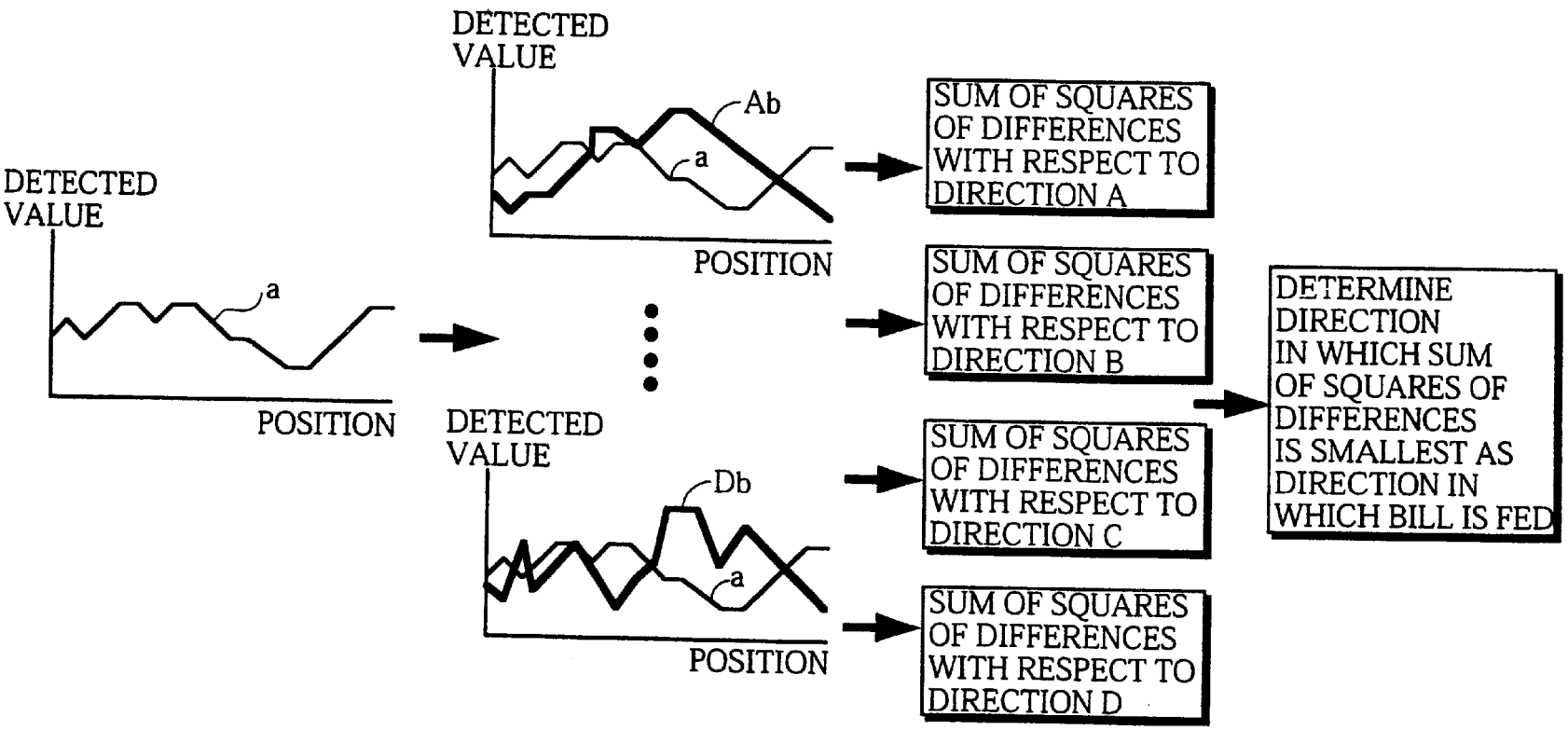
FIG. 5 is a schematic view showing the procedure for processing for judging the direction in which a bill is fed.

FIG. 4 shows the detailed procedure for the processing for judging the direction in which a bill is fed in the step 5 shown in FIG. 3. Further, FIG. 5 schematically shows the procedure for the processing for judging the direction of feeding.

The processing for judging the direction of feeding is performed on the basis of an input waveform obtained on the basis of the detected value of the photosensor 11*b* or 21*b* receiving infrared light. It shall be performed on the basis of the input waveform obtained on the basis of the photosensor 11*b*. Specifically, the input waveform represents the relationship of an amount of light transmission (a detected value) to a position on the line L1 of the bill 1, as indicated by a polygonal line a in FIG. 5.

The relationship of the amount of light transmission to the position on the line L1 of the bill 1 differs depending on the direction in which the bill is fed. The relationship of the amount of light transmission to the position on the line L1 of the bill 1 (hereinafter referred to as a reference waveform for each direction of feeding) is previously found for each direction of feeding (a direction A, a direction B, a direction C, and a direction D) using a true bill. In FIG. 5, a reference waveform Ab for each direction of feeding with respect to the direction A and a reference waveform Db for each direction of feeding with respect to the direction D are illustrated.

For each reference waveform for each direction, the sum of the squares of the differences between the reference waveform for each direction and the input waveform a is calculated (step 21). That is, letting di (i=1, 2, 3 . . . m) be the differences between the reference waveform for each direction and the input waveform at positions where characteristic amounts are read, the sum D of the squares of the differences between the reference waveform for each direction and the input waveform is expressed by the following equation (1):

$$D = \sum_{i=1}^{m} di^2 \tag{1}$$

The direction in which the sum D of the squares of the differences is the smallest is taken as the direction in which the bill is fed (step 22).

Since dirt such as dirt from the hands generally adheres on a bill circulating on the market, the detected value is liable to be decreased as a whole.

Therefore, it is preferable that the level of the input waveform is adjusted by comparing the input waveform with at least one reference waveform for each direction of feeding, and processing in the step 21 is performed using the input waveform after the level adjustment.

Figure 6:
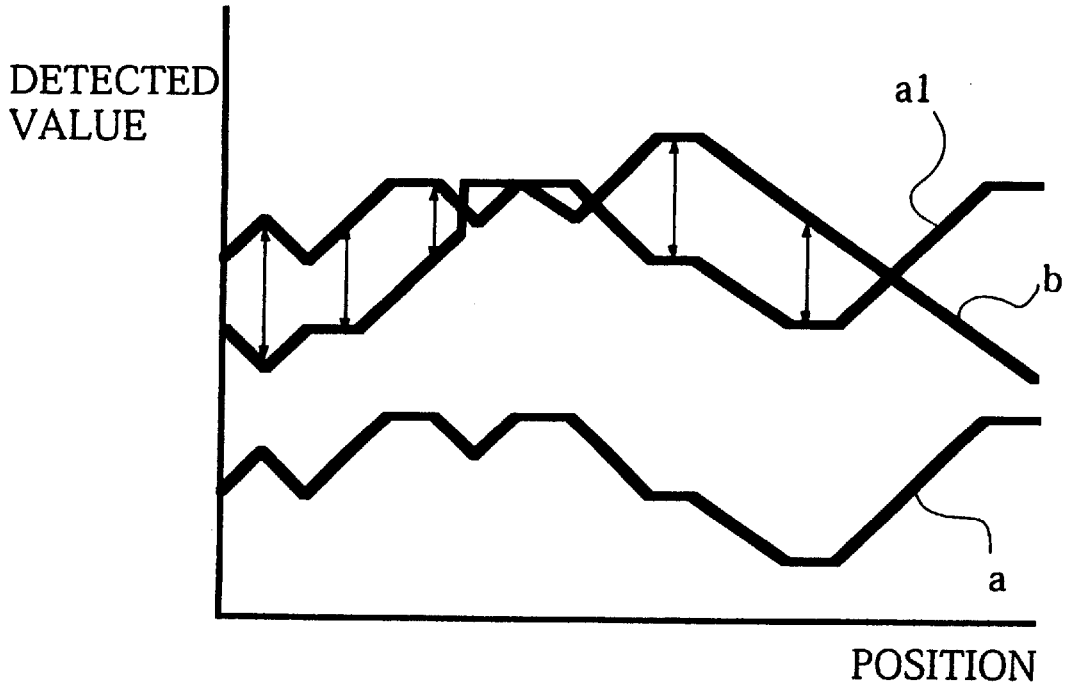
FIG. 6 is a graph for explaining a method of correcting an input waveform.

The level adjustment is made by making parallel translation of the original input waveform a so that the level of the input waveform a coincides with the level of a reference waveform b for each direction or feeding, as shown in FIG. 6. The input waveform after the parallel translation is indicated by a1 in FIG. 6. More specifically, parallel translation of the original input waveform a is so made that the average value of the differences at the respective positions for reading between the input waveform a1 after the translation and the reference waveform b for each direction of feeding becomes zero.

Positions for reading, which are to be positions where an operation is to be executed (points to be operated), for calculating the sum of the squares of the differences may not be all positions for reading on the line L1. That is, the sum of the squares of the differences may be calculated using as the points to be operated a plurality of positions for reading selected from all the positions for reading on the line L1.

Reference waveforms for four directions of feeding may be previously prepared for each of three types of bills, that is, a 10,000-yen bill, a 5,000-yen bill, and 1,000-yen bill, for example, the sums of the squares of the differences between the 12 types of reference waveforms for each direction of feeding and the input waveform may be respectively calculated in the foregoing step 21, and the type of the bill and the direction of feeding in a case where the sum of the squares of the differences is the smallest may be judged as the type of the bill and the direction of feeding. As a result, it is possible to judge not only the direction of feeding but also the type of the bill.

Figure 7:
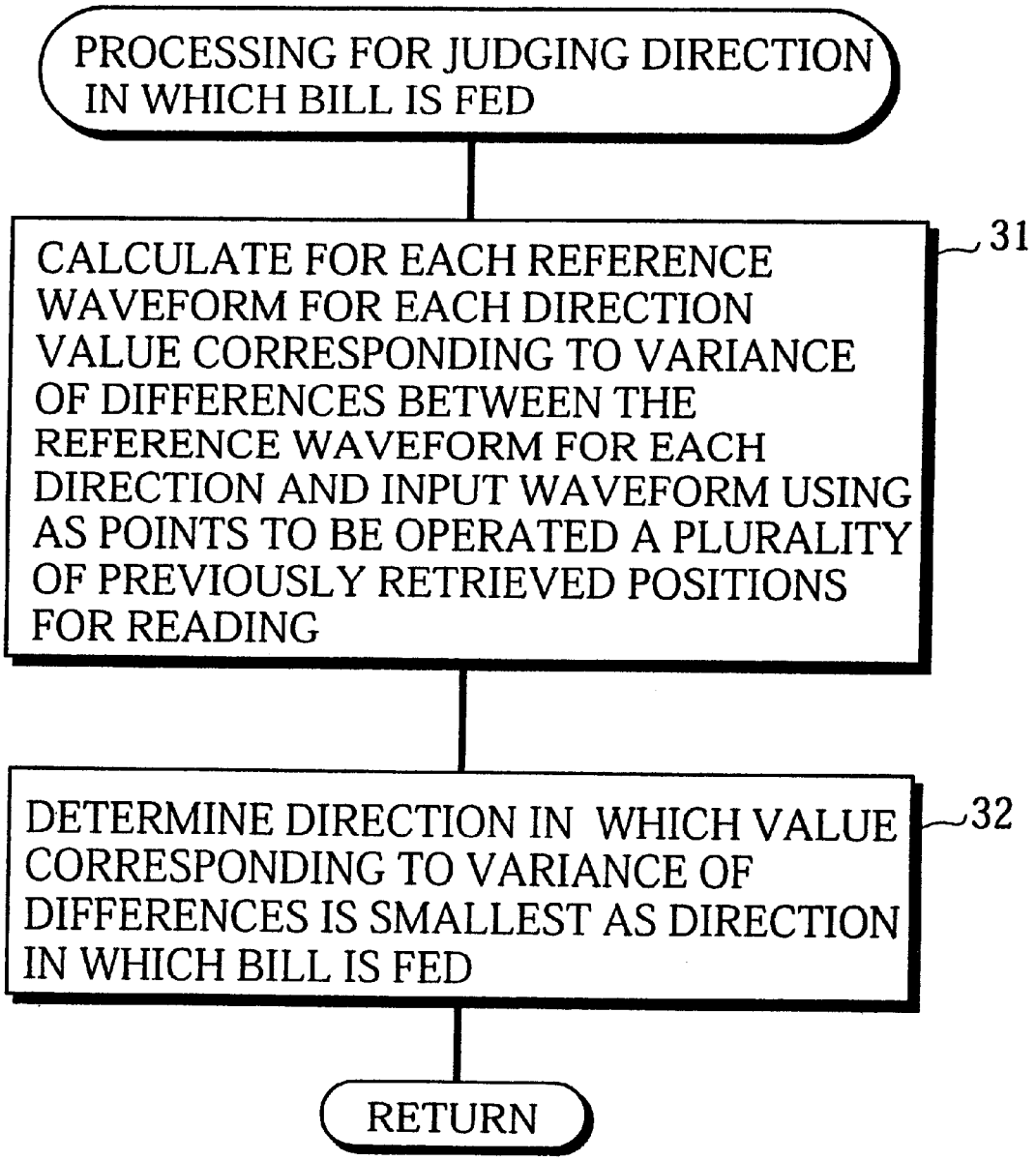
FIG. 7 is a flow chart showing the other procedure for processing for judging the direction in which a bill is fed.

FIG. 7 shows another example of processing for judging the direction in which a bill is fed.

The processing for judging the direction in which a bill is fed shall be also performed on the basis of an input waveform obtained on the basis of the photosensor 11*b*. Further, a true bill is used as the bill 1, to find for each direction of feeding the relationship of an amount of light transmission to a position on the line L1 of the bill 1 (hereinafter referred to as a reference waveform for each direction of feeding).

A plurality of previously retrieved positions where characteristic amounts are read are used as points to be operated, to calculate for each reference waveform for each direction of feeding a value corresponding to a variance of the differences between the reference waveform for each direction of feeding and the input waveform (step 31). Specifically, letting di (i=1, 2, 3 . . . n) be the differences between the reference waveform for each direction and the input waveform at positions for reading previously retrieved as points to be operated, and *d be the average value of the differences di, a value σ corresponding to the variance of the differences between the reference waveform for each direction and the input waveform is expressed by the following equation (2):

$$\sigma = \sum_{i=1}^{n} (di - {}^{*}d)^2 \tag{2}$$

The direction in which the value σ corresponding to the variance of the differences is the smallest is taken as the direction in which the bill is fed (step 32).

The reason why the value σ corresponding to the variance of the differences is used for judging the direction in which the bill is fed is as follows. That is, a bill circulating on the market is dirty, so that the detected value is liable to be decreased as a whole. Therefore, it is preferable to calculate the sum of the squares of the differences between the input waveform and the reference waveform for each direction of feeding after making parallel translation of the input waveform so that the average value of errors between the input waveform and the reference waveform for each direction of feeding becomes zero. The value σ corresponding to the variance of the differences is calculated on the basis of the idea.

Description is made of a method of retrieving positions for reading which are to be points to be operated.

The positions for reading which are to be points to be operated are retrieved by optimization processing using a genetic algorithm (hereinafter referred to as GA).

Figure 8:
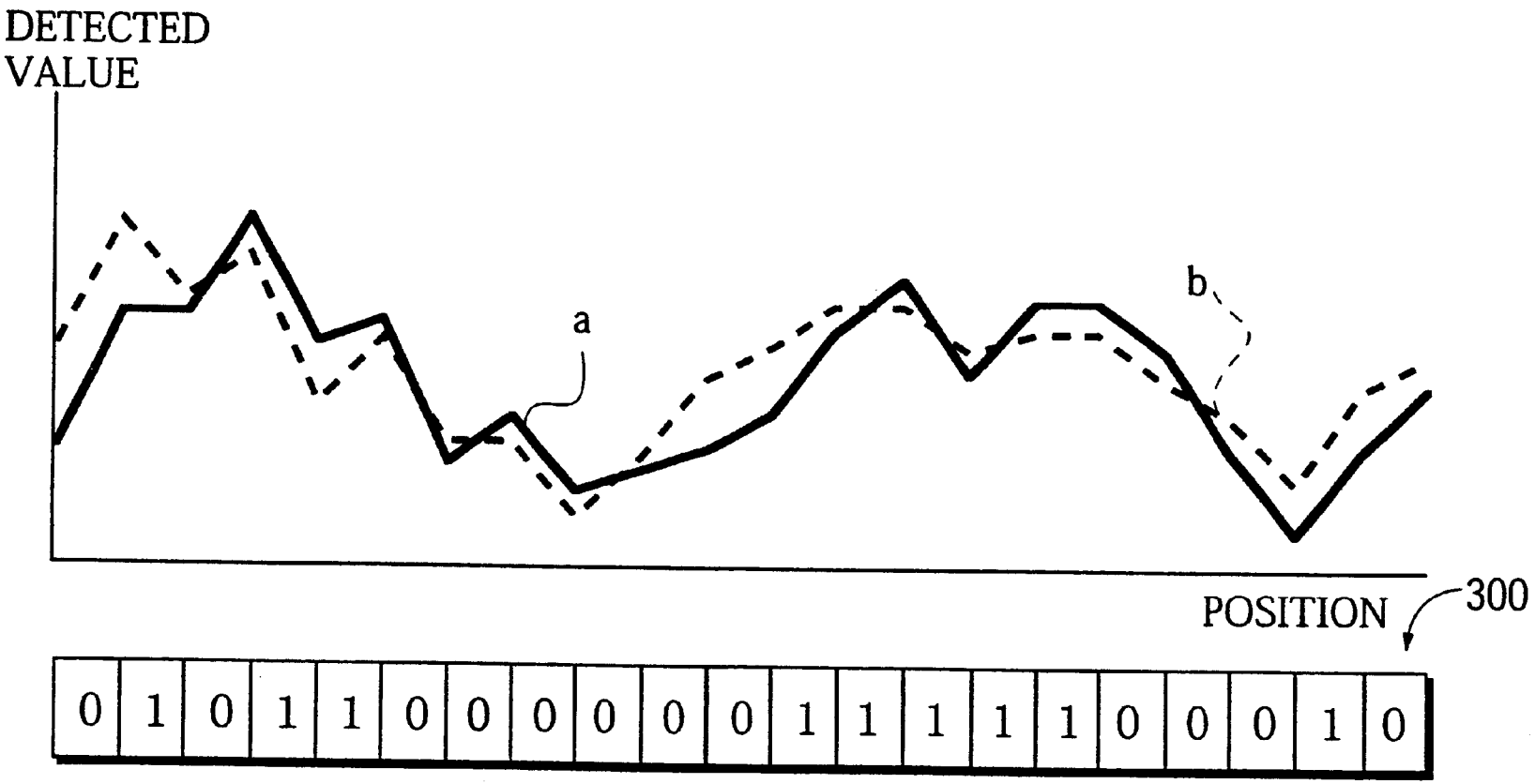
FIG. 8 is a schematic view showing an individual.

An individual 300 is represented as shown in FIG. 8. A polygonal line a shown in FIG. 8 indicates an input waveform, and a polygonal line b indicates a reference waveform for each direction of feeding. The individual 300 has genes corresponding to respective positions for reading, and each of the genes takes a value "0" or "1". "0" indicates that a detected value at the position for reading corresponding to the gene is not taken as a point to be operated, and "1" indicates that a detected value at the position for reading corresponding to the gene is taken as a point to be operated.

The individual is evaluated on the basis of an evaluation function expressed by the following equation (3). That is, the evaluation function becomes the number of genes taking the value "1".

$$\text{Evaluation function} = \text{the number of positions for reading taken as points to be operated} \tag{3}$$

Figure 9:
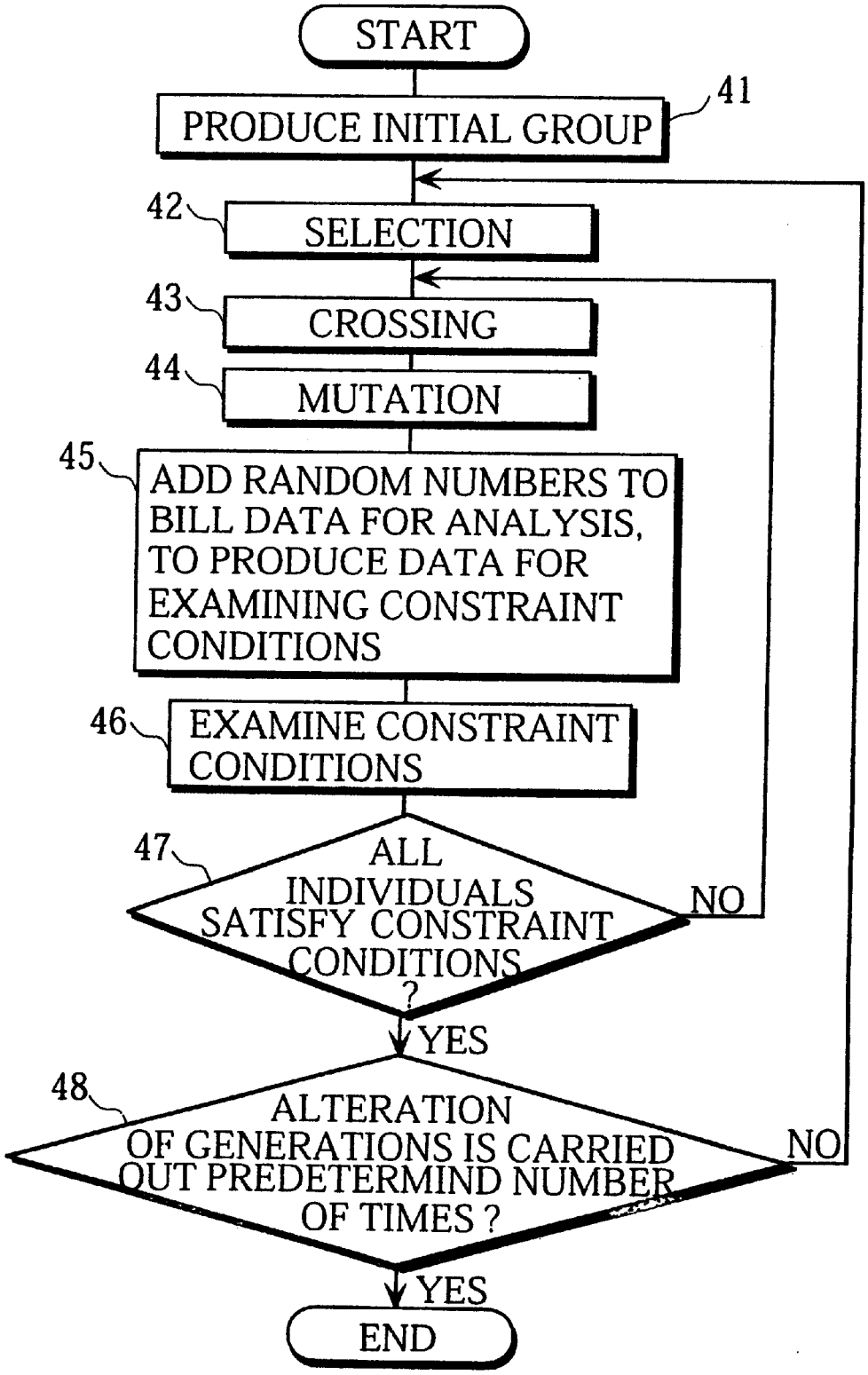
FIG. 9 is a flow chart showing the procedure for optimization processing of points to be operated by GA.

FIG. 9 shows the procedure for the optimization processing using GA.

An initial population is first produced (step 41). That is, a previously set number of individuals are produced by random numbers. However, only individuals whose rates of correct answers to the judgment of the direction of feeding (%) are 100% with respect to all bill data for analysis previously prepared are employed.

In this example, input waveforms for each of four directions of feeding corresponding to 40 bills are prepared as bill data for analysis. The direction in which a bill is fed is judged using all the bill data for analysis with respect to the individuals produced by random numbers. The rate of correct answers to the judgment of the direction of feeding (%) is calculated with respect to the individuals. The individuals whose rates of correct answers to the judgment of the direction of feeding are not 100% are not employed as the initial population. 20 individuals whose rates of correct answers to the judgment of the direction of feeding are 100% are thus produced.

Selection processing is then performed (step 42). Specifically, an evaluated value of each of the individuals is calculated using the evaluation function, whereby the individuals in the upper half which take low evaluated values are selected, and the other individuals are discarded. Consequently, ten individuals are selected.

Two arbitrary individuals are then selected out of the individuals selected in the step 42, and the selected individuals cross each other (step 43). The individuals cross each other ten times, so that 20 new populations are produced. Uniform crossing, for example, is used as the crossing.

Thereafter, one individual is selected, so that a mutation is developed (step 44). That is, the value of an arbitrary gene of the selected individual is inverted.

Random numbers are then added to bill data for analysis previously prepared, to produce data for examining constraint conditions (step 45). In this example, input waveforms for each of four directions of feeding corresponding to 40 bills are prepared as the bill data for analysis. Random numbers are added to each of the bill data for analysis, to produce data for examining constraint conditions.

Figure 10:
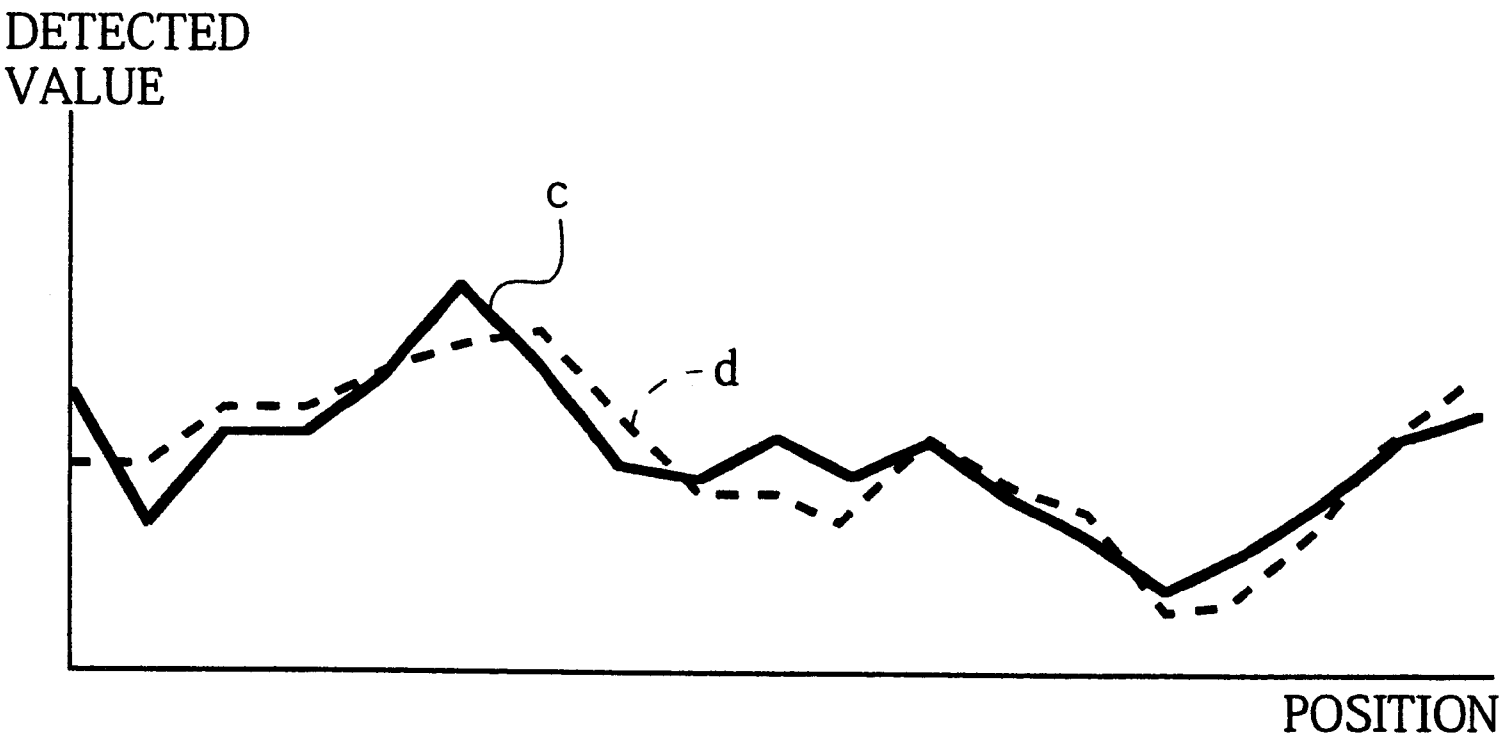
FIG. 10 is a graph for explaining that data for examining constraint conditions is produced by adding random numbers to previously prepared bill data for analysis.

Specifically, as shown in FIG. 10, random numbers δ in a defined range are produced for each of detected values at positions where characteristic amounts are read of bill data for analysis c, and the produced random numbers δ are added to the detected value, to produce data for examining constraint conditions d.

Thereafter, with respect to each of the 20 individuals obtained by the processing in the steps 43 and 44, it is examined whether or not constraint conditions are satisfied using the data for examining constraint conditions produced in the step 45 (step 46). Specifically, the direction in which a bill is fed is judged for each individual using all the data for examining constraint conditions. The rate of correct answers to the judgment of the direction of feeding (%) is calculated for each individual. Individuals whose rates of correct answers to the judgment of the direction of feeding are not 100% are discarded.

When there exists even one individual whose rate of corrected answers to the judgment of the direction of feeding is not 100% (NO in step 47), the program is returned to the step 43, whereby individuals whose number corresponds to the number of individuals discarded are produced by crossing from the remaining individuals. The processing in the steps 44 to 47 is performed.

When the rate of correct answers to the judgment of the direction of feeding becomes 100% with respect to all the individuals by repeating the processing in the steps 43 to 47

(YES in step 47), it is judged whether or not alternation of generations is carried out a predetermined number of times, for example, 1000 times (step 48). When the alternation of generations is not carried out a predetermined number of times, the program is returned to the step 42, after which the processing in the step 42 and the subsequent steps is performed again.

When it is judged in the step 48 that the alternation of generations is carried out a predetermined number of times, the processing is terminated. One individual is selected out of the remaining individuals, and positions where characteristic amounts are read which correspond to a value "1" in the gene of the selected individual are determined as points to be operated.

Description is made of the results of experiments. 200 types of initial populations are advanced to the 1000-th generation using 160 (40 for each of four directions) bill data for analysis. The rate of corrected answers to the judgment of the direction of feeding is calculated using 4000 (1000 for each of four directions) bill data for evaluation which differ from the bill data for analysis every 100 generations.

Figure 11:
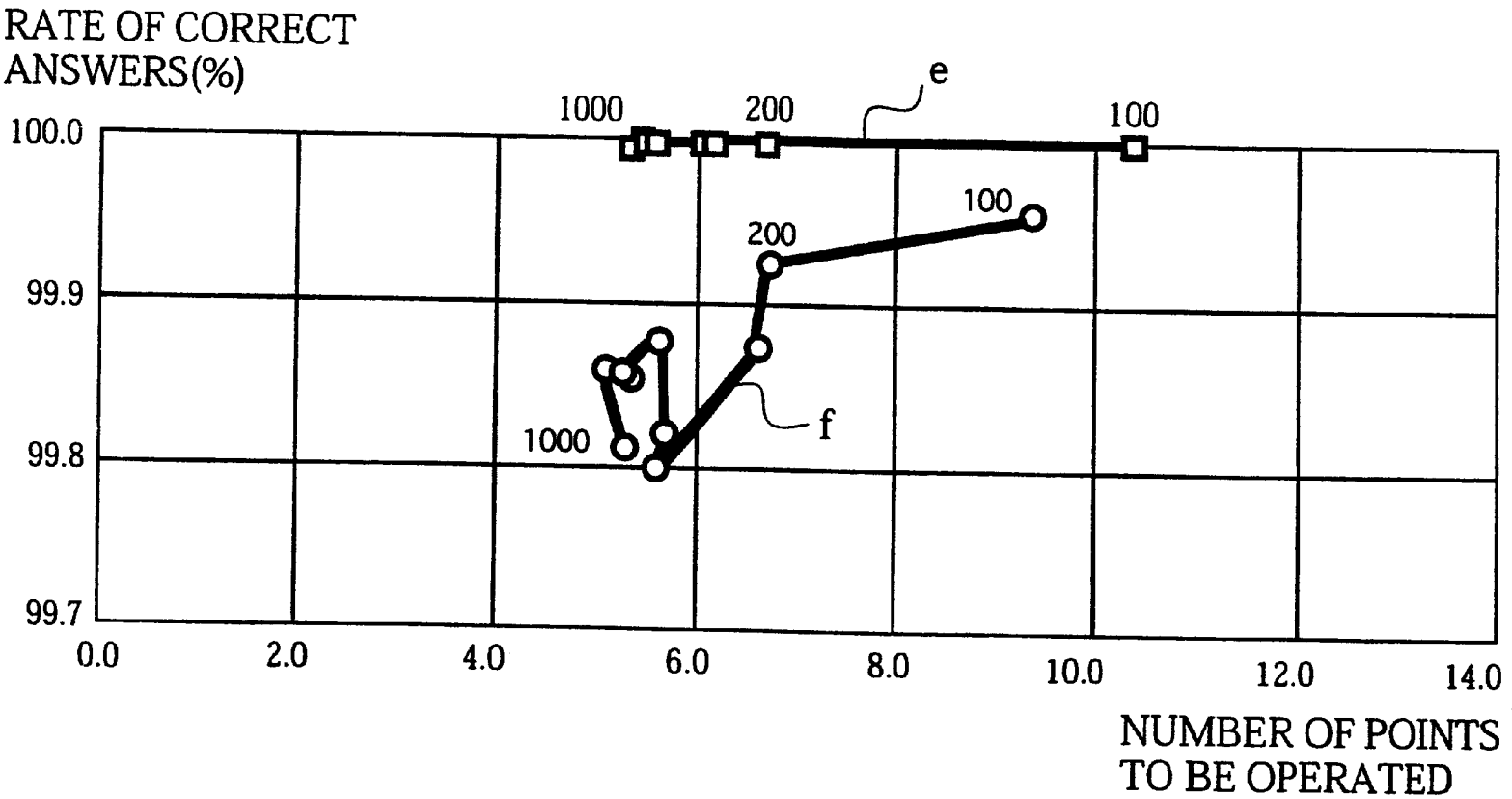
FIG. 11 is a graph showing the average value of the numbers of points to be operated which are optimized by GA and the average value of the rates of corrected answers to the judgment of the direction of feeding.

FIG. 11 shows the average value of the numbers of points to be operated which are optimized by GA and the average value of the rates of corrected answers to the judgment of the direction of feeding.

A polygonal line e in FIG. 11 indicates the results of experiments in a case where random numbers whose upper limit is 4 are added to previously prepared bill data for analysis, to produce data for examining constraint conditions. A polygonal line f in FIG. 11 indicates the results of experiments in a case where no random numbers are added to previously prepared bill data for analysis so that the bill data for analysis is used as it is as data for examining constraint conditions.

In GA in which no random numbers are added to previously prepared bill data for analysis, the rate of correct answers to the judgment of the direction of feeding is reduced as alteration of generations proceeds. This is considered to be a result of retrieval of an answer low in versatility dependent on bill data for analysis. On the other hand, in a method shown in the above-mentioned embodiment, even if the alternation of generations proceeds, the rate of correct answers to the judgment of the direction of feeding is high. This is considered to be a result of retrieval of an answer high in versatility. In order to obtain an answer high in versatility, it is considered that the number of bill data for analysis is increased. If the number of bill data for analysis is increased, however, it takes long to retrieve the answer.

Table 1 shows the results of comparison between operation time in a case where processing for judging the direction of feeding is performed using five points to be operated which are obtained in the above-mentioned embodiment and operation time in a case where processing for judging the direction of feeding is performed using continuous 100 points to be operated. As can be seen from the Table, in the processing for judging the direction of feeding using the method shown in the above-mentioned embodiment, operation time is significantly reduced, as compared with that in a case where the number of objects to be summed is not decreased.

TABLE 1

| | rate of correct answers | operation time |
|---|---|---|
| judgment of direction using 5 points to be operated obtained by this method | 100% | 20 msec |
| judgment of direction using 100 points to be operated | 100% | 100 msec |

Although in the above-mentioned embodiment, random numbers are added to bill data for analysis previously prepared in order to improve the rate of correct answers to the judgment of the direction of feeding, to produce data for examining constraint conditions, no random numbers may be added to the previously prepared bill data for analysis so that the bill data for analysis is used as it is as data for examining constraint conditions.

Furthermore, although in the above-mentioned embodiment, the direction in which a value corresponding to a variance of the differences between detected values at positions where characteristic amounts are read which are determined as objects to be summed and a previously prepared reference signal for each of four directions of feeding is the smallest is judged to be the direction of feeding, the direction in which a statistic such as the sum of the squares of the differences between detected values at positions where characteristic amounts are read which are determined as objects to be summed and a previously prepared reference signal for each of four directions of feeding and the sum of the absolute values of the differences is the smallest may be judged to be the direction of feeding.

[5] Description of Processing for Correcting Shift in Conveyance

Figure 12:
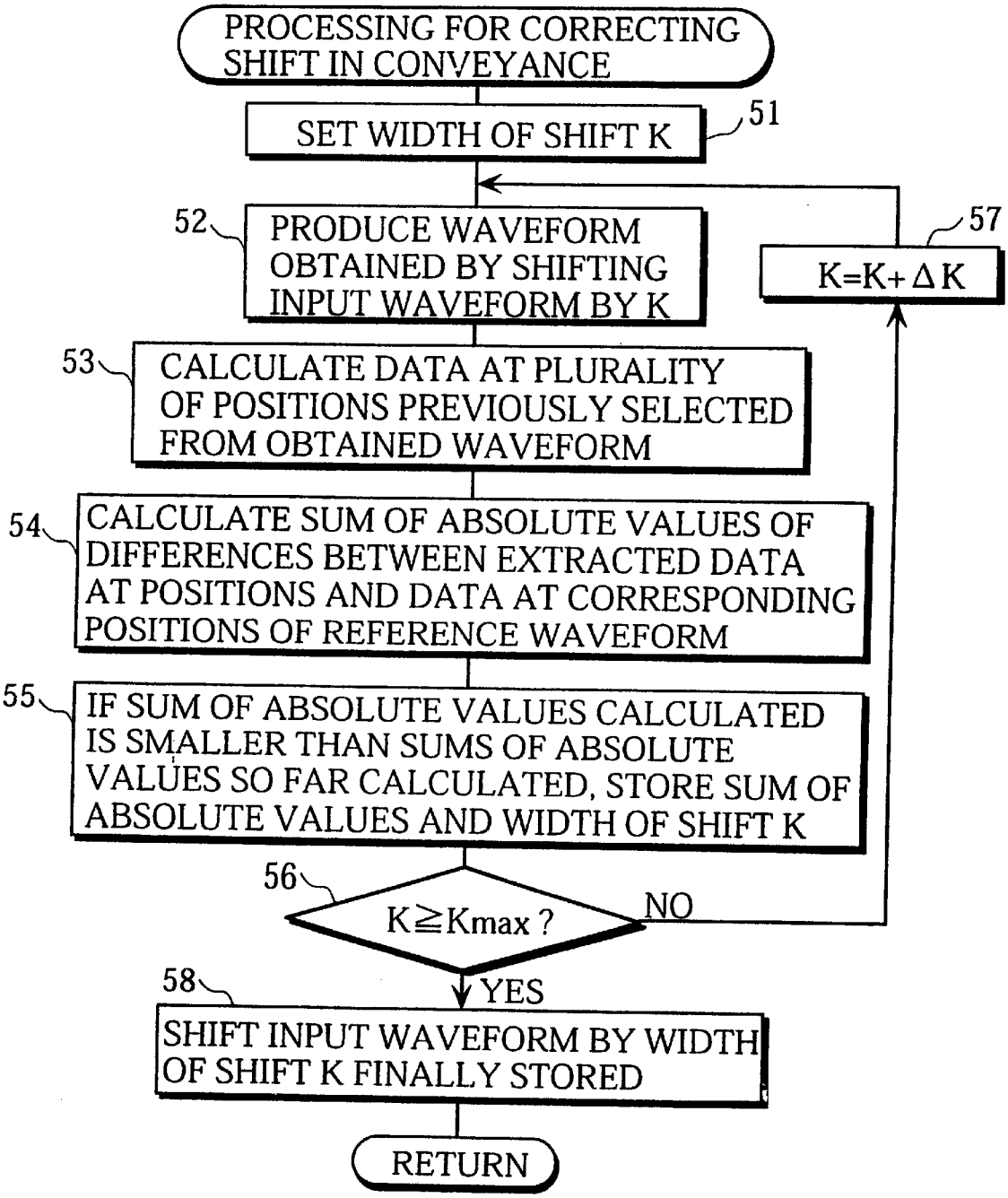
FIG. 12 is a flow chart showing the procedure for processing for correcting the shift in conveyance.

FIG. 12 shows the detailed procedure for processing for correcting the shift in conveyance in the step 7 shown in FIG. 3.

Processing for correcting the shift in conveyance is performed for each of four types of input waveforms corresponding to a case where a bill is fed in the reference direction of feeding.

A width of shift K is first set (step 51). The width of shift K is set to a value between the minimum width of shift and the maximum width of shift which may occur in the direction of conveyance. The minimum width of shift is first set.

Figure 13:
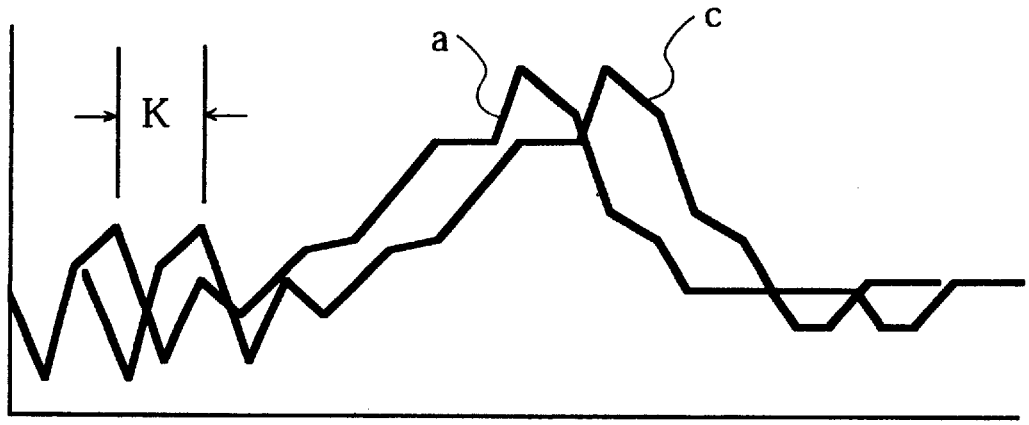
FIG. 13 is a waveform diagram for explaining processing in the step 52 shown in FIG. 12.

A waveform obtained by shifting an input waveform in the direction of conveyance by the set width of shift K (a waveform for calculating a width of shift) is produced (step 52). That is, a waveform c obtained by shifting an input waveform a in the direction of conveyance by the width of shift K is produced, as shown in FIG. 13.

Figure 14:
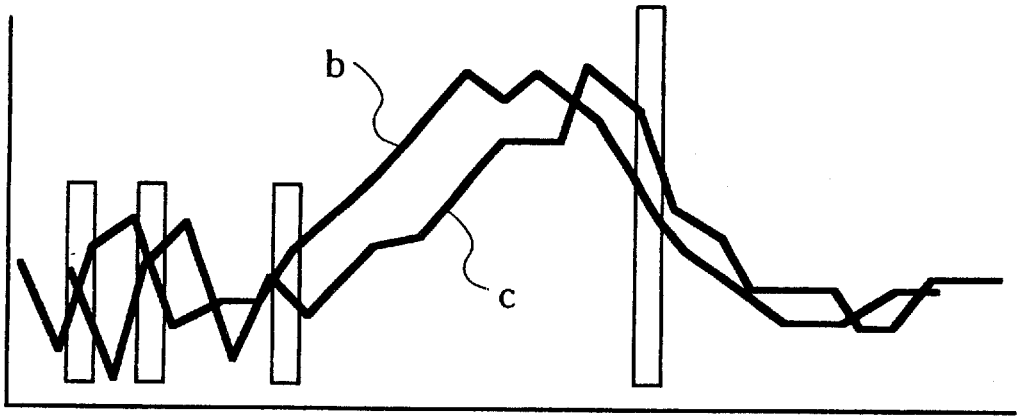
FIG. 14 is a waveform diagram for explaining processing in the step 54 shown in FIG. 12.

Data at a plurality of positions (positions where an operation is to be executed) previously selected as described later are then extracted on the basis of the obtained waveform c (step 53). As shown in FIG. 14, the sum of the absolute values of the differences between the values of the extracted data at the respective positions and the values of data at corresponding positions of a reference waveform b previously prepared (hereinafter referred to as the sum of the absolute values) is calculated (step 54).

If the sum of the absolute values calculated this time is smaller than the minimum value of the sums of the absolute values so far calculated, the sum of the absolute values is stored as the minimum value of the sum of the absolute values, and the value of the width of shift K is stored (step 55). When the sum of the absolute values is not calculated until the processing for correcting the shift in conveyance is started, its calculated value is stored as the minimum value of the sum of the absolute values.

It is then judged whether or not the set width of shift K is the maximum value Kmax (step 56). If the set width of shift K is not the maximum value Kmax, the width of shift K is updated to a value which is larger by a threshold ΔK (step 57), after which the program is returned to the step 52. The processing in the steps 52 to 57 is thus repeated. When the processing in the steps 52 to 55 is performed with respect to the maximum width of shift K, the answer is in the affirmative in the step 56, after which the program proceeds to the step 58. In the step 58, the input waveform is shifted by the width of shift K finally stored in the step 55. The shift of the input waveform from the reference waveform in the direction of conveyance of the bill is corrected.

Although the sum of the absolute values of the differences between the values of the extracted data at the respective positions and the values of the data at corresponding positions of the reference waveform b previously prepared is calculated in the step 54, the sum of the squares of the differences between the values of the extracted data at the respective positions and the values of the data at corresponding positions of the reference waveform b previously prepared (hereinafter referred to as the sum of the squares of the differences) may be calculated. In this case, in the above-mentioned step 55, if the sum of the squares of the differences is smaller than the minimum value of the sum of the squares of the differences so far calculated, the sum of the squares of the differences is stored as the minimum value of the sum of the squares of the differences, and the value of the width of shift K is stored.

Figure 15:
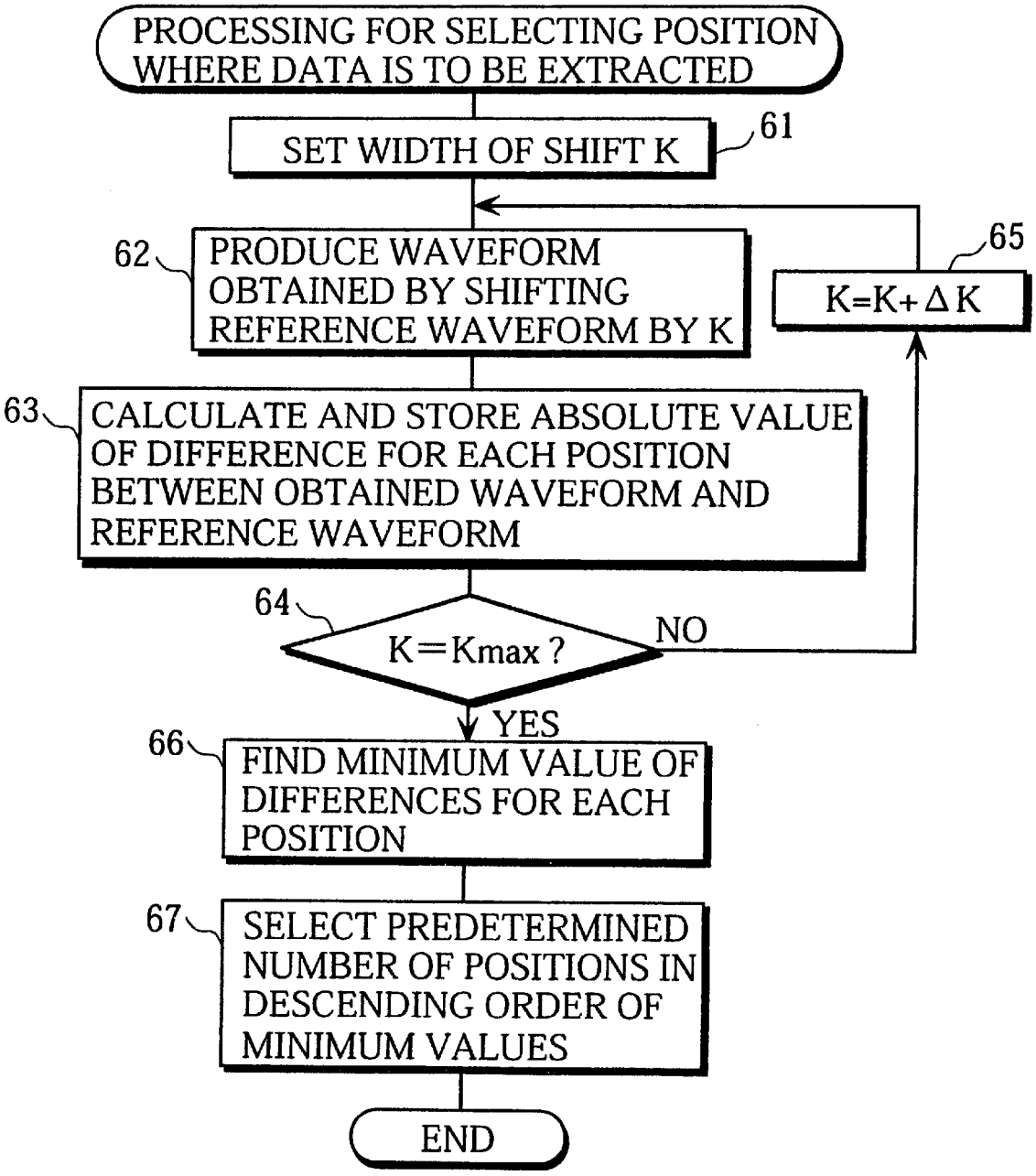
FIG. 15 is a flow chart showing a method of finding points to be operated which are employed in the step 53 shown in FIG. 12.

FIG. 15 shows a method of finding positions where data is to be extracted (positions where an operation is to be executed) in the step 53.

A width of shift K is first set (step 61). The width of shift K is set to a value between the minimum width of shift and the maximum width of shift which may occur in the direction of conveyance. The minimum width of shift is first set.

A waveform obtained by shifting the reference waveform produced on the basis of a true bill which is not dirty and is not broken in the direction of conveyance by the set width of shift K (a waveform for calculating a position where an operation is to be executed) is produced (step 62). The absolute value of the difference for each position between the obtained waveform and the reference waveform is calculated and stored (step 63).

It is then judged whether or not the set width of shift K is the maximum value Kmax (step 64). When the set width of shift K is not the maximum value, the width of shift K is updated to a value which is larger by a threshold ΔK (step 65), after which the program is returned to the step 62. The processing in the steps 62 to 65 is thus repeated. When the processing in the steps 62 to 63 is performed with respect to the maximum width of shift K, the answer is in the affirmative in the step 64, after which the program proceeds to the step 66.

In the step 66, the minimum value of the differences (the absolute values) so far found is found for each position, and is stored as the minimum value for the position. A predetermined number of positions are selected in descending order of the minimum values out of the respective positions (step 67). The selected positions are used as positions where data is to be extracted in the step 53 shown in FIG. 12.

[6] Description of First Precise Judgment Processing

First precise judgment processing is performed on the basis of an input waveform based of infrared light corresponding to the line L1 and an input waveform based on infrared light corresponding to the line L2 out of four types of input waveforms after performing the processing for correcting the shift in conveyance.

Since judgment processing using the input waveform based on infrared light corresponding to the line L1 and judgment processing using the input waveform based on infrared light corresponding to the line L2 are the same processing, description is made of only the first precise judgment processing performed on the basis of the input waveform based on infrared light corresponding to the line L1.

Description is now made of the idea of the first precise judgment processing. The dirt of a bill is not uniform in respective portions of the bill. Therefore, a forecast model of variation components caused by the dirt, the wrinkle, and the like of respective portions on the line L1 in a case where it is assumed that a true bill is fed in the reference direction (hereinafter merely referred to as a forecast model of dirt components) is previously produced.

Random components on the line L1 of a bill to be examined are extracted on the basis of the input waveform based on infrared light corresponding to the line L1 after performing the processing for correcting the shift in conveyance.

Dirt components on the line L1 of the bill to be examined are predicted on the basis of the random components on the line L1 found from the bill to be examined and the forecast model of dirt components on the line L1. The distribution of random components on the line L1 found from the bill to be examined and the predicted distribution of dirt components on the line L1 of the bill to be examined are compared with each other, to find a value relating to a prediction error. If the value relating to the found prediction error exceeds a predetermined range, it is judged that the bill is a false bill.

Figure 16:
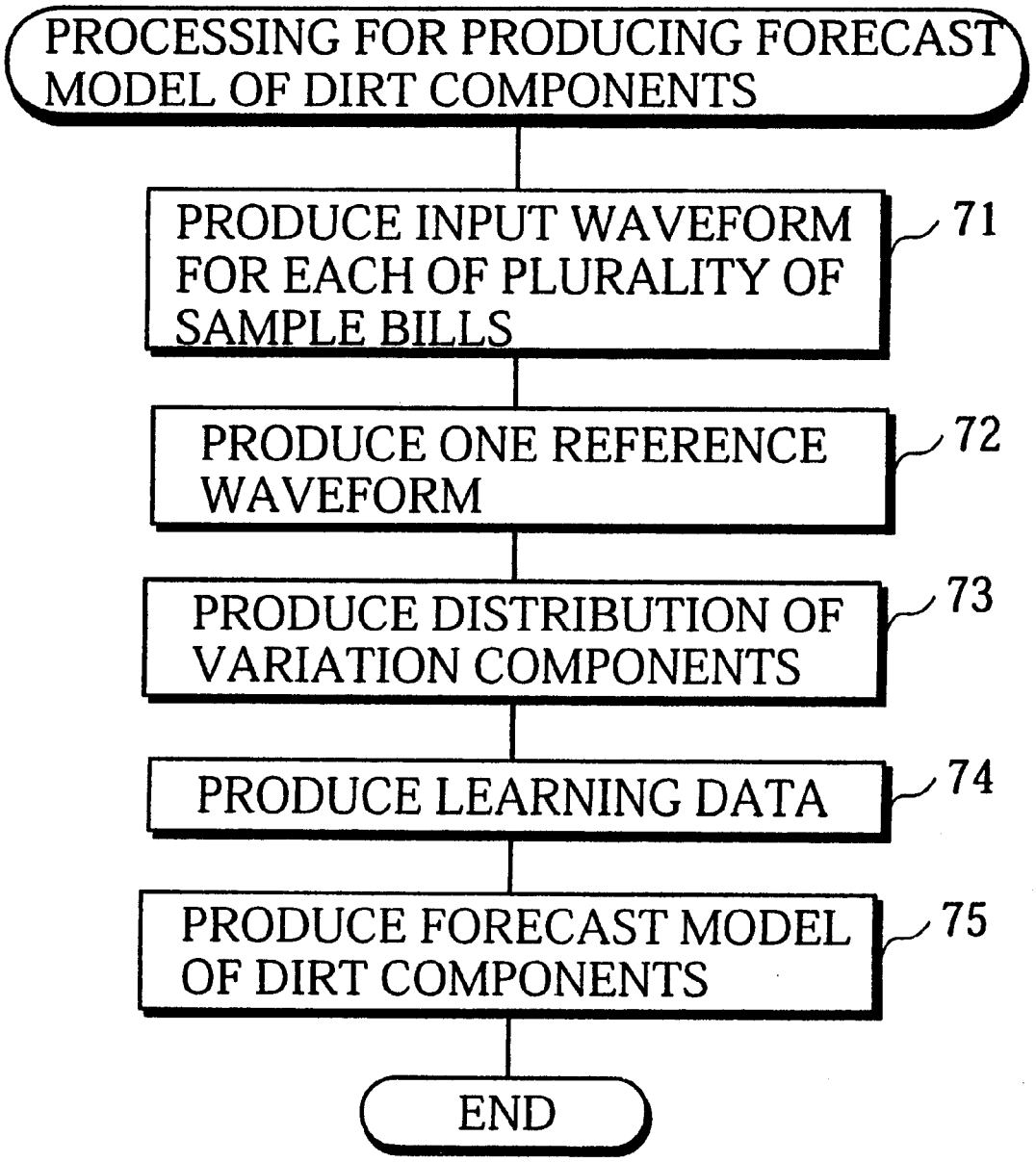
FIG. 16 is a flow chart showing the procedure for processing for producing a forecast model of dirt components.

FIG. 16 shows the procedure for processing for producing a forecast model of dirt components. Description is made of a case where a forecast model of dirt components corresponding to the line L1 in a case where it is assumed that a bill is fed in the reference direction is produced.

Figure 17:
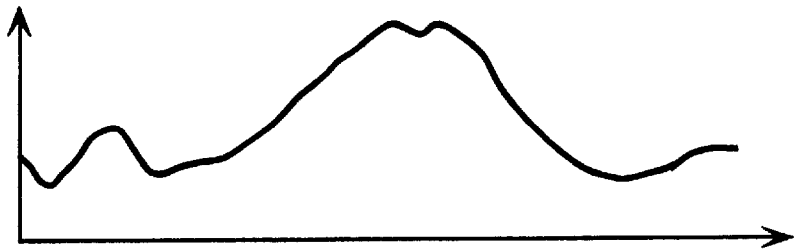
FIG. 17 is a waveform diagram showing an input waveform obtained on the basis of sample bills.

An input waveform representing the relationship of an amount of transmission of infrared light to each of positions on the line L1 is first produced with respect to each of a plurality of true bills actually used (hereinafter referred to as sample bills), as shown in FIG. 17 (step 71).

Figure 18:
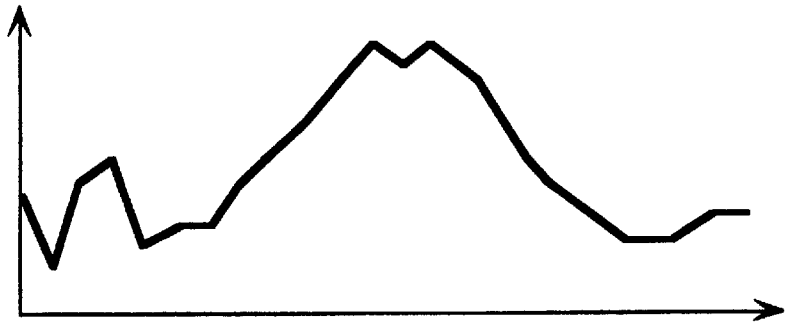
FIG. 18 is a waveform diagram showing a reference waveform.

One reference waveform as shown in FIG. 18 is produced on the basis of the input waveform corresponding to each of the sample bills (step 72). Data at each of positions of the reference waveform is found by calculating the average value of corresponding positions of the input waveform corresponding to each of the sample bills, for example.

Figure 19:
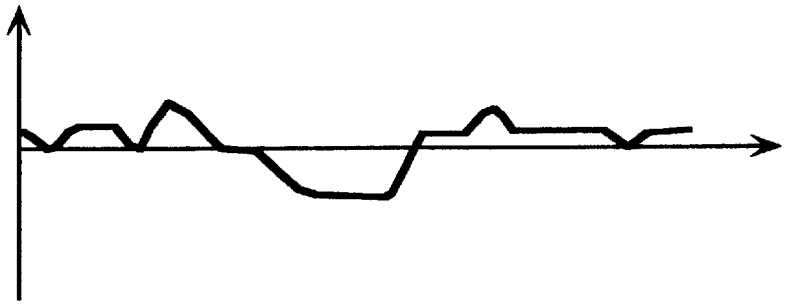
FIG. 19 is a waveform diagram showing the distribution of variation components such as dirt and wrinkle which are produced for each sample bill.

The difference from the reference waveform is then calculated for the input waveform corresponding to each of the sample bills, so that the distribution of variation components such as dirt and wrinkle is produced for each sample bill, as shown in FIG. 19 (step 73).

Figure 20:
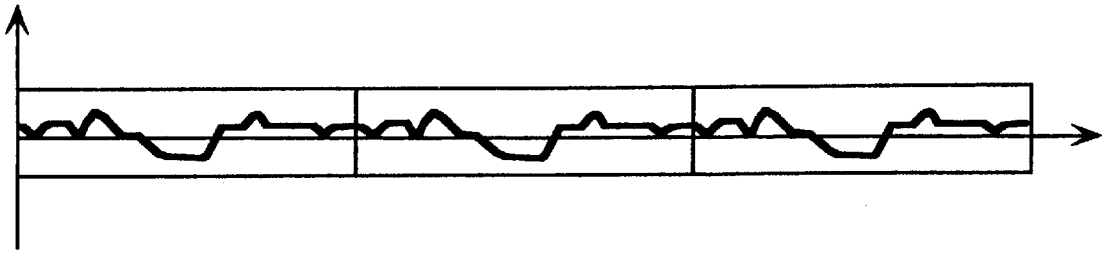
FIG. 20 is a waveform diagram showing learning data.

Learning data as shown in FIG. 20 is produced by arranging the distributions of the variation components for the respective sample bills in a time series (step 74).

A forecast model of dirt components corresponding to the line L1 is then produced on the basis of the learning data (step 75).

That is, an autoregressive model (a forecast model of dirt components) as expressed by the following equation (4) is first produced by taking the learning data as a periodic time series signal:

$$X(n)=\alpha_1 \cdot X(n-1)+\alpha_2 \cdot X(n-2)+\ldots+\alpha_p \cdot X(n-p) \quad (4)$$

In the foregoing equation (4), X(n) represents dirt at the present time, and X(n−1) to X(n−p) represent dirt at past times. Further, $a_1$ to $a_p$ represent prediction factors. The prediction factors $a_1$ to $a_p$ are determined by a method of least squares, for example, so that the prediction precision is the highest.

A forecast model of dirt components corresponding to the line L2 of the bill is produced in the same manner.

Figure 21:
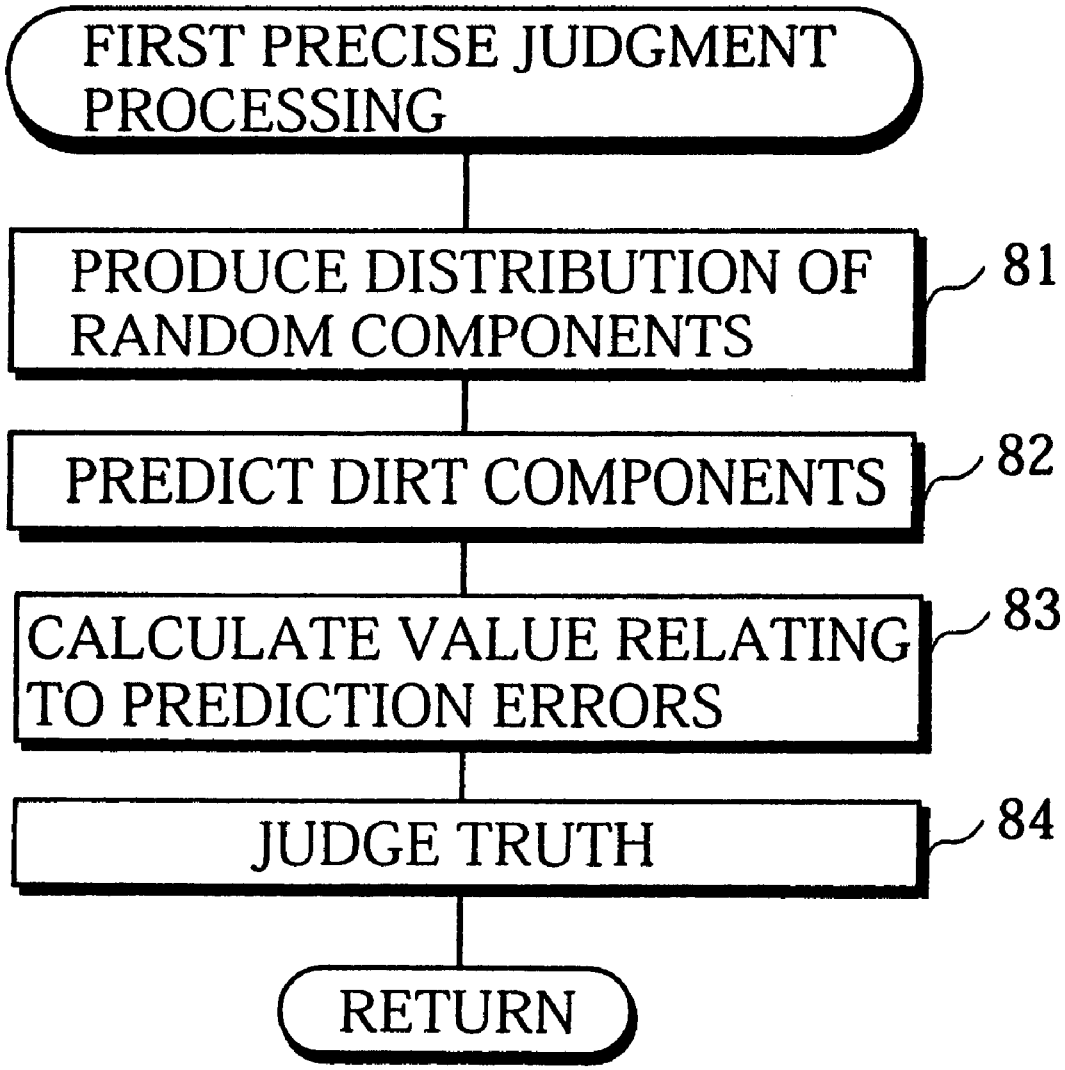
FIG. 21 is a flow chart showing the procedure for first precise judgment processing.

FIG. 21 shows the procedure for the first precise judgment processing.

Description is made of the first precise judgment processing performed on the basis of the input waveform based on infrared light corresponding to the line L1 after performing the processing for correcting the shift in conveyance.

Figure 22:
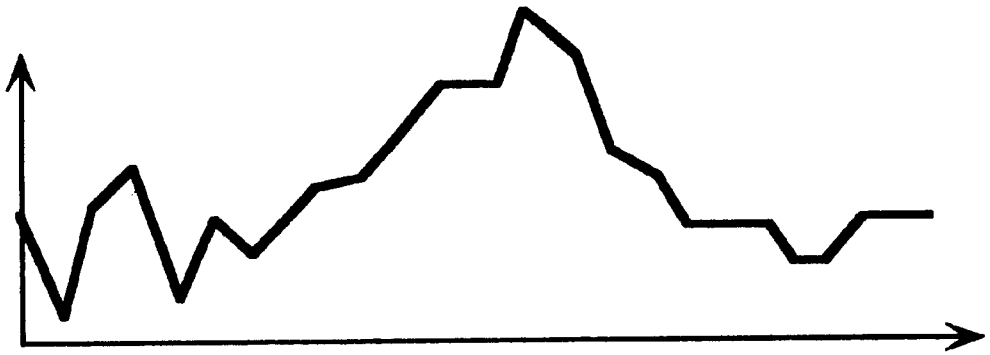
FIG. 22 is a waveform diagram showing an input waveform after performing processing for correcting the shift in conveyance.
Figure 23:
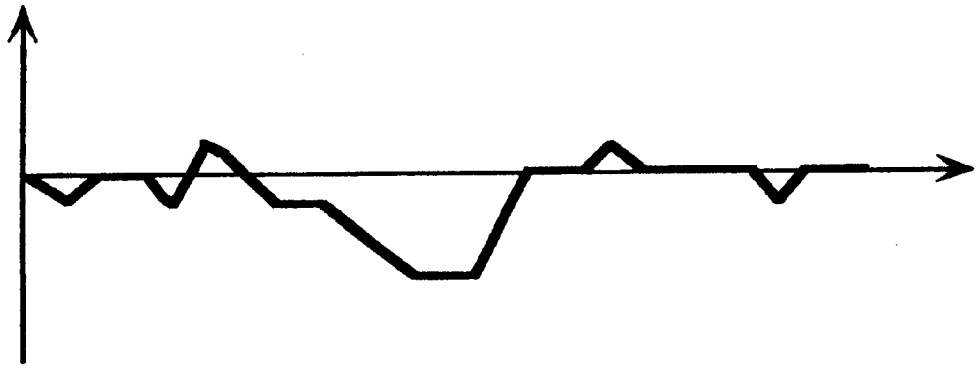
FIG. 23 is a waveform diagram showing the distribution of random components.

The difference between an input waveform based on infrared light corresponding to the line L1 after performing the processing for correcting the shift in conveyance as shown in FIG. 22 and the reference waveform shown in FIG. 18 is first calculated, whereby the distribution of random components as shown in FIG. 23 is produced (step 81).

Figure 24:
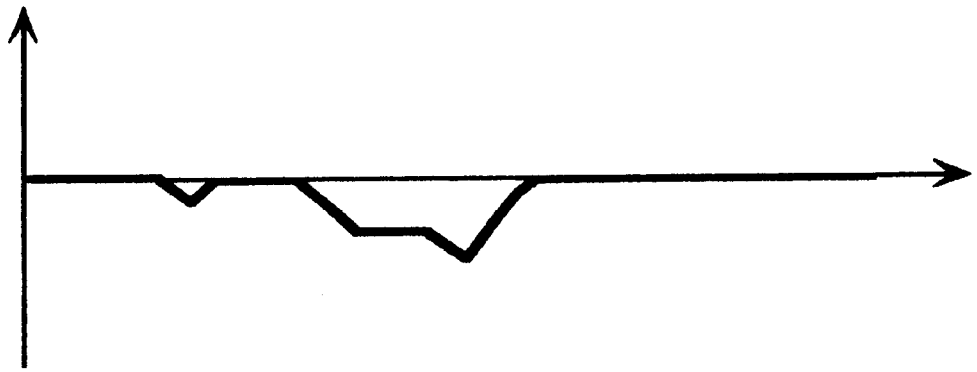
FIG. 24 is a waveform diagram showing the predicted distribution of dirt components of a bill to be examined.

Dirt components on the line L1 of the bill to be examined are predicted on the basis of the random components on the line L1 found from the bill to be examined and the forecast model of dirt components on the line L1 (step 82). That is, the dirt component X(n) at certain time (at a certain position) on the line L1 of the bill to be examined is obtained by substituting X(n−1), X(n−2), . . . X(n−p) in data representing the random components into the above-mentioned equation (4). Consequently, the predicted distribution of dirt components on the line L1 of the bill to be examined is obtained, as shown in FIG. 24.

The distribution of random components on the line L1 found from the bill to be examined and the predicted distribution of dirt components on the line L1 of the bill to be examined are compared with each other, to find the sum of the squares of prediction errors (a value relating to prediction errors) step 83). That is, the sum of the squares of the differences in respective portions between the distribution of random components on the line L1 and the predicted distribution of dirt components of the bill to be examined is found. The truth is judged by comparing the found value relating to prediction errors and a predetermined range with each other (step 84). If the found value relating to prediction errors exceeds the predetermined range, it is judged that the bill is a false bill.

Figure 25:
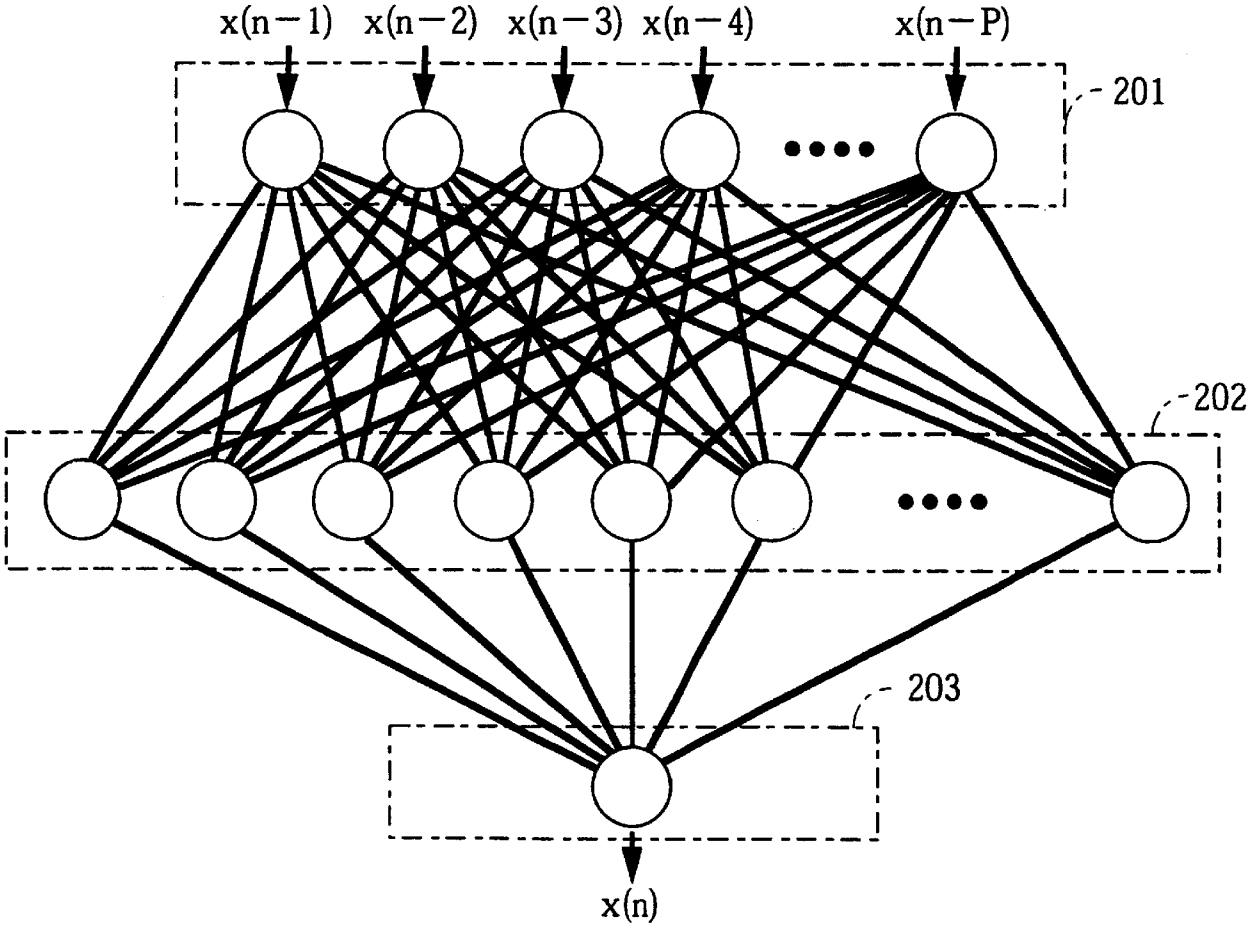
FIG. 25 is a schematic view showing an example of a neural network used in place of an autoregressive model.

The above-mentioned autoregressive model may be replaced with a forecast model using a neural network, as shown in FIG. 25. The neural network is composed of an input layer 201, an intermediate layer 202, and an output layer 203, as well known.

The learning of the neural network is performed on the basis of the learning data obtained in the foregoing step 74. Specifically, the learning of the neural network is performed using the data X(n−1), X(n−2), . . . X(n−p) representing the past times as input patterns and using the data X(n) representing the present time as teacher data.

The data X(n−1), X(n−2), . . . X(n−p) representing the past times corresponding to certain present time n in the distribution of random components produced in the foregoing step 81 are inputted to the neural network after the learning, whereby the data X(n) representing the present time n is outputted from the neural network.

A multiple regression model may be used as a forecast model of dirt components of a bill.

When the multiple regression model is used as the forecast model of dirt components of the bill, dirt Z at a certain position on the bill is represented by the following equation (5), for example:

$$Z=\alpha_1 \cdot Y_{1+\alpha 2} \cdot Y_{2+\alpha 3} \cdot Y_{3+\alpha 4} \cdot Y_4 \tag{5}$$

In the above-mentioned equation (5), $Y_1$ is the amount of change representing the position of data to be an object, $Y_2$ is the amount of change representing the variation in data representing the amount of transmission, $Y_3$ is the amount of change representing the concentration of ink, and $Y_4$ is the amount of change representing the degree of degradation of paper. Further, $a_1$, $a_2$, $a_3$, and $a_4$ are weighting factors, and are previously found on the basis of the amounts of change $Y_1$, $Y_2$, $Y_3$, and $Y_4$ obtained from a plurality of true bills (sample bills).

The amounts of change $Y_1$, $Y_2$, $Y_3$, and $Y_4$ obtained from the bill to be examined are substituted into the equation (5), whereby dirt X corresponding to each position on the bill to be examined is calculated.

In this case, the amount of change $Y_1$ representing the position of data is obtained from an encoder connected to a conveying motor in a case where the bill is accepted, for example.

An example of the amount of change $Y_2$ representing the variation in data is a variance disp of the differences between an input waveform representing an amount of transmission obtained from the bill to be examined and a reference waveform representing an amount of transmission obtained from the plurality of sample bills (the reference waveform shown in FIG. 18, for example). The variance disp is found by the following equation (6), letting di (i=1, 2, 3 , . . . n) be the differences between the input waveform and the reference waveform at respective positions on the bill to be examined, and *d be the average value of the differences di:

$$disp = \frac{\sum_{i=1}^{n} (di - {}^{*}d)^2}{n-1} \tag{6}$$

Furthermore, an example of the amount of change $Y_3$ representing the concentration of ink is a variance ink of the differences between a detected waveform representing the concentration of the ink obtained from the bill to be examined and a reference waveform representing the concentration of ink found from the plurality of sample bills. That is, if the variance ink is large, the difference between white and black is large, so that it is judged that the ink is thick. If the variance ink is small, the difference between white and black is small, so that it is judged that the ink is thin. The variance ink is found by the following equation (7), letting ei (i=1, 2, 3 . . . n) be the differences between the detected value of the concentration of the ink and a reference value of the concentration of the ink at respective positions, and *e be the average value of the differences ei:

$$ink = \frac{\sum_{i=1}^{n} (ei - {}^{*}e)^2}{n-1} \tag{7}$$

Furthermore, an example of the amount of change $Y_4$ representing the degree of degradation of paper is the average value *f of the differences between a detected value of a transmission rate in a white portion of the bill to be examined and a reference value of transmission rates in white portions of the plurality of sample bills. The average value *f is found by the following equation (8), letting Qi be the transmission rates at respective positions in the white portion of the bill to be examined and Si(i=1, 2, 3 . . . n) be reference values of the transmission rates at the respective positions in the white portions of the sample bills:

$$^{*}f = \frac{\sum_{i=1}^{n}(Qi - Si)}{n} \tag{8}$$

Furthermore, the multiple regression model may be replaced with a forecast model using a neural network. Specifically, the learning of the neural network is performed using as the amounts of change $Y_1$, $Y_2$, $Y_3$, and $Y_4$ corresponding to the respective positions obtained from the plurality of sample bills as input patterns and using the dirt at the positions obtained from the plurality of sample bills as teacher data.

The amounts of change $Y_1$, $Y_2$, $Y_3$, and $Y_4$ at the respective positions obtained from the bill to be examined are inputted to the neural network after the learning, whereby the dirt Z at each of the positions is outputted from the neural network.

[7] Description of Second Precise Judgment Processing

Second precise judgment processing is performed on the basis of an input waveform based on red light corresponding to the line L1 and an input waveform based on red light corresponding to the line L2 out of four types of input waveforms after performing the processing for correcting the shift in coveyance. In both judgment processing using the input waveform based on red light corresponding to the line L1 and judgment processing using the input waveform based on red light corresponding to the line L2, only when it is judged that a bill to be examined is a true bill, it is judged that the bill to be examined is a true bill. That is, the answer is in the negative in the step 11 shown in FIG. 3.

Since the judgment processing using the input waveform based on red light corresponding to the line L1 and the judgment processing using the input waveform based on red light corresponding to the line L2 are the same processing, description is made of only the judgment processing using the input waveform based on red light corresponding to the line L1.

Figure 26:
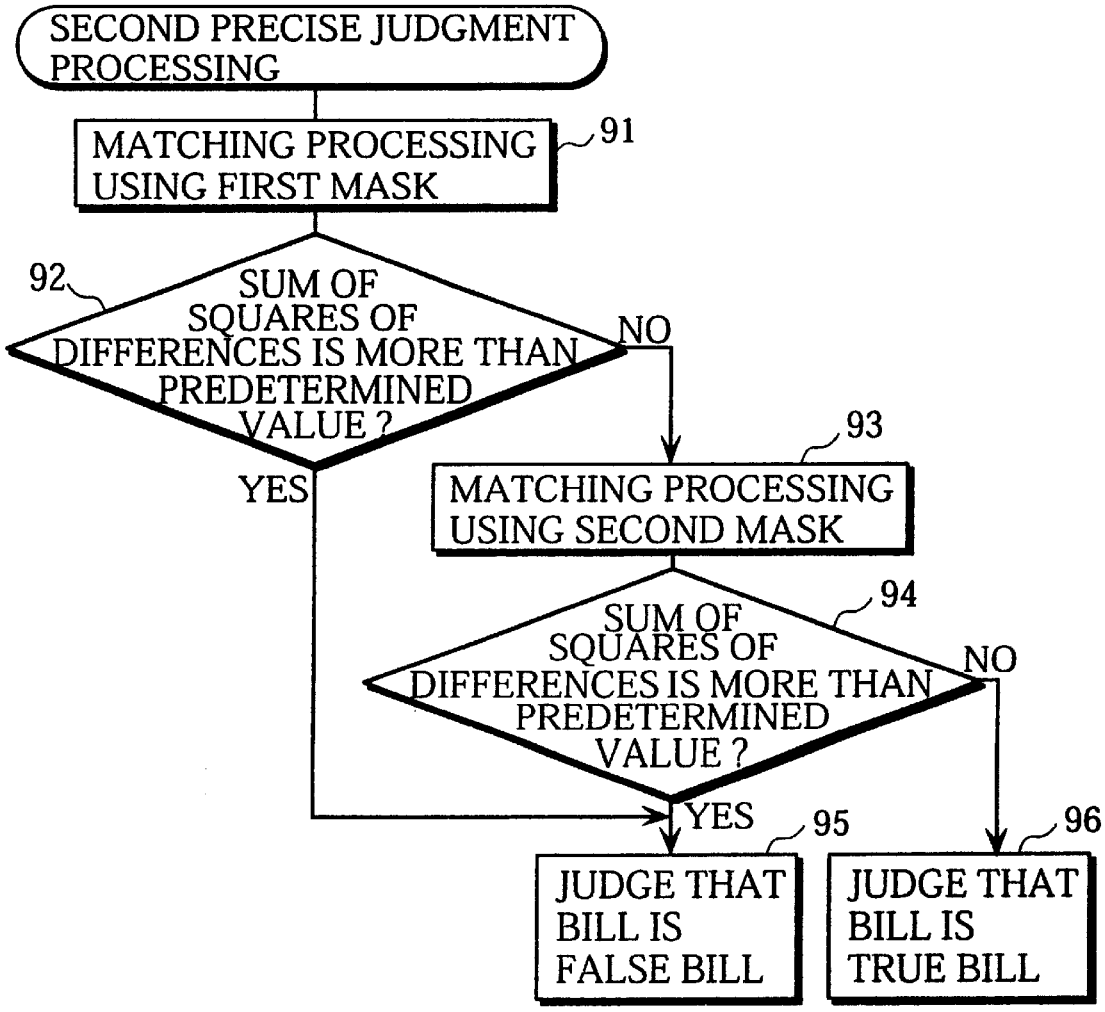
FIG. 26 is a flow chart showing the procedure for processing of second precise judgment processing.

FIG. 26 shows the detailed procedure for the second precise judgment processing in the step 10 shown in FIG. 3.

Figure 27:
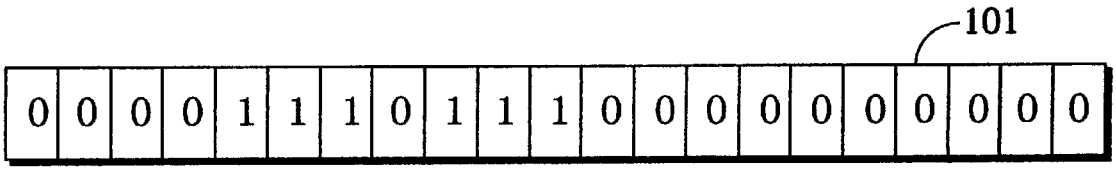
FIG. 27 is a schematic view showing a first mask.
Figure 28:
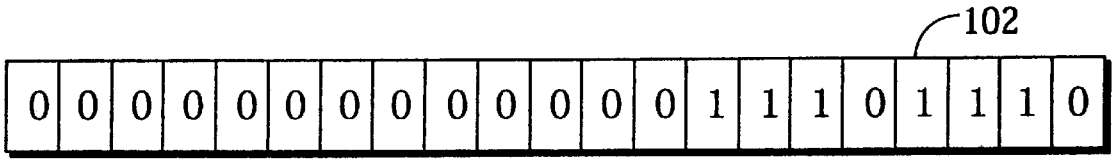
FIG. 28 is a schematic view showing a second mask.

Input waveforms corresponding to the line L1 are produced using red light with respect to a plurality of true bills (sample bills), and one reference waveform is previously produced from the input waveforms. A mask representing a position where a characteristic amount is read, which is to be a position where an operation is to be executed, on the line L1 is previously prepared by a method as described later. In this example, as shown in FIG. 27 and 28, two types of masks 101 and 102 shall be prepared. In FIGS. 27 and 28, squares of each of the masks 101 and 102 correspond to respective positions where characteristic amounts are read on the line L1. The square in which "1" is written indicates that its position is a point to be operated, and the square in which "0" is written indicates that its position is not a point to be operated.

Matching processing using the firs tmask 101 is first performed (step 91). Specifically, the difference between the input waveform based on red light corresponding to the line L1 and the reference waveform corresponding to the line L1 is found for each of the positions where characteristic amounts are read, which are to be positions where an operation is to be executed, represented by the first mask 101 is found, and the sum of the squares of the differences therebetween at the respective positions (hereinafter referred to as the sum of the squares of the differences) is calculated.

It is judged whether or not the obtained sum of the squares of the differences is not more than a threshold (step 92). When the obtained sum of the squares of the differences is more than the threshold (YES in step 92), it is judged that the bill to be examined is a false bill (step 95). Consequently, in this case, the answer is in the affirmative in the step 11 shown in FIG. 3.

When the obtained sum of the squares of the differences is not more than the threshold (NO in step 92), matching processing using the second mask 102 is performed (step 93). Specifically, the difference between the input waveform based on red light corresponding to the line L1 and the reference waveform corresponding to the line L1 is found for each of the positions where characteristic amounts are read, which are to be positions where an operation to be executed, represented by the second mask 102 is found, and the sum of the squares of the differences therebetween at the respective positions (hereinafter referred to as the sum of the squares of the differences) is calculated.

It is judged whether or not the obtained sum of the squares of the differences is not more than a threshold (step 94). When the obtained sum of the squares of the differences is more than the threshold (YES in step 94), it is judged that the bill to be examined is a false bill (step 95). Consequently, in this case, the answer is in the affirmative in the step 11 shown in FIG. 3.

When the obtained sum of the squares of the differences is not more than the threshold (NO in step 94), it is judged that the bill to be examined is a true bill (step 96).

Description is made of a method of producing a mask. The mask is produced by optimization processing using a genetic algorithm (hereinafter referred to as GA).

An individual is represented as shown in FIG. 8, as described in the processing for judging the direction in which a bill is fed. The individual has genes corresponding to respective positions where characteristic amounts are read, and each of the genes takes a value "0" or "1". "0" indicates that a detected value of the position for reading corresponding to the gene is not taken as a point to be operated, and "1" indicates that a detected value of the position for reading corresponding to the gene is taken as a point to be operated.

In this example, input waveforms corresponding to a plurality of true bills are prepared as true bill data for analysis, and input waveforms corresponding to a plurality of false bills are prepared as false bill data for analysis.

Figure 29:
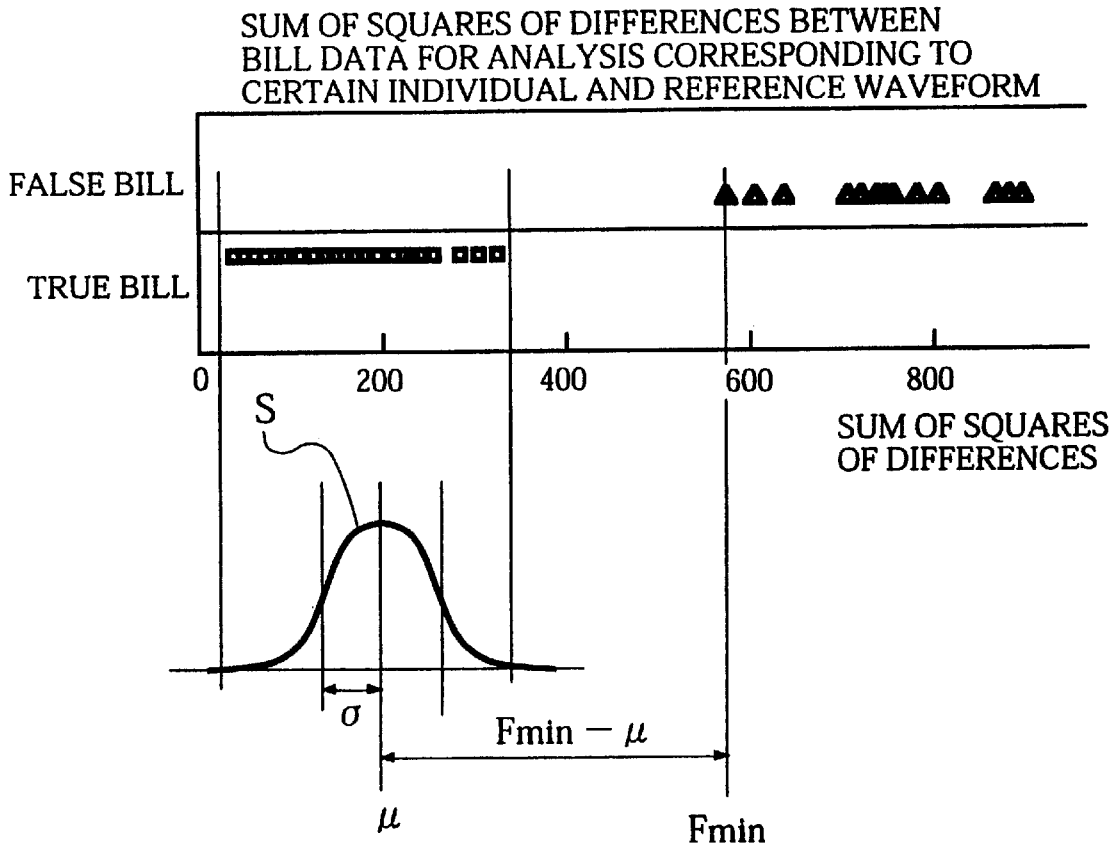
FIG. 29 is a graph showing a distribution curve of the sum of the squares of the differences between bill data for analysis corresponding to a certain individual and a reference waveform and the sum of the squares of the differences between bill data for analysis of true bills corresponding to the individual and the reference waveform.

FIG. 29 illustrates the sum of the squares of the differences between bill data for analysis corresponding to a certain individual and a reference waveform (the sum of the squares of the differences) and a distribution curve S of the sum of the squares of the differences between true bill data for analysis corresponding to the individual and the reference waveform.

The sum of the squares of the differences between the bill data for analysis corresponding to a certain individual and a reference waveform is prepared by performing the following operation with respect to the respective bill data for analysis. Specifically, the differences between the bill data for analysis and the reference waveform are found for respective points to be operated represented by the individual, and the sum of the squares of the differences is found.

In FIG. 29, a square mark represents the sum of the squares of the differences corresponding to each of the true bill data for analysis, and a triangular mark represents the sum of the squares of the differences corresponding to each of the false bill data for analysis.

The individual is evaluated on the basis of a distance scale R expressed by the following equation)9):

$$R = \frac{F\min - \mu}{\sigma} \quad (9)$$

In the equation (9), R represents the distance scale. Fmin represents the minimum value of the sums of the squares of the differences corresponding to the false bill data for analysis. $\mu$ represents the average value of the distributions of the sums of the squares of the differences corresponding to the true bill data for analysis. Further, $\sigma$ represents the standard deviation of the distributions of the sums of the squares of the differences corresponding to the true bill data for analysis.

Figure 30:
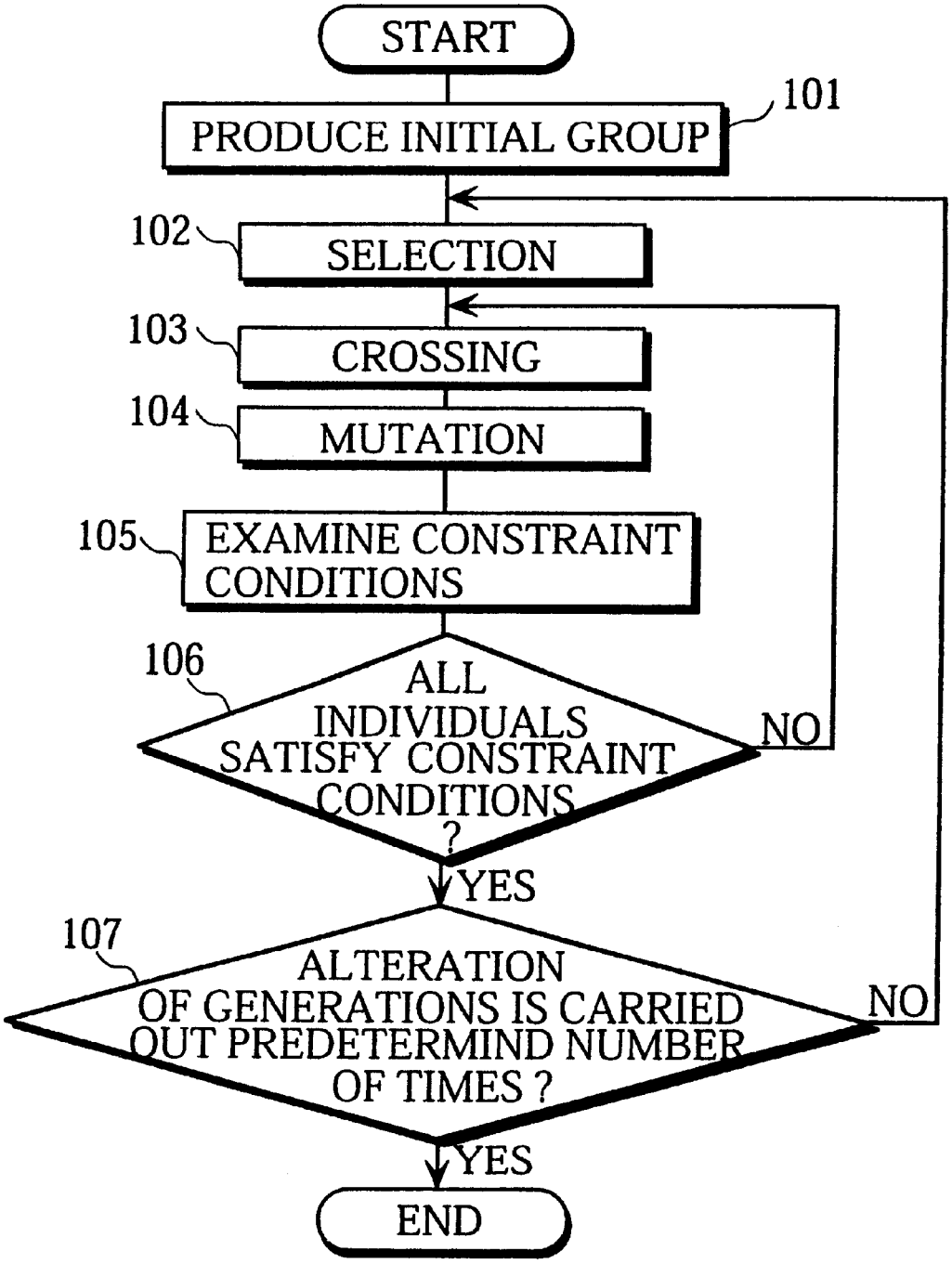
FIG. 30 is a flow chart showing the procedure for optimization processing by GA.

FIG. 30 shows the procedure for optimization processing using GA.

An initial population is first produced (step 101). That is, a previously set number of individuals are produced by random numbers. The number of points to be operated of each of the produced individuals shall be not more than ten. The distance scales R are calculated using all the bill data for analysis with respect to the individuals produced by the random numbers. 20 individuals are produced in descending order of the distance scales R.

Selection processing is then performed (step 102). Specifically, the distance scales R corresponding to the respective individuals are calculated, whereby the individuals in the upper half which have large distance scales R are selected, and the other individuals are discarded. Consequently, ten individuals are selected.

Two arbitrary individuals are then selected out of the individuals selected in the step 102, and the selected individuals cross each other (step 103). The individuals cross each other ten times, so that 20 new populations are produced. Uniform crossing, for example, is used as the crossing.

Thereafter, one individual is selected, so that a mutation is developed (step 104). That is, the value of an arbitrary gene of the selected individual is inverted.

It is then examined whether or not each of the 20 individuals obtained by the processing in the foregoing steps 103 and 104 satisfies constraint conditions (step 105). That is, it is examined for each individual whether or not the number of points to be operated is not more than ten. Individuals having points to be operated whose number exceeds ten are discarded.

When there exists even one individual which does not satisfy the constraint conditions (NO in step 106), the program is returned to the step 103. In the step 103, individuals whose number corresponds to the number of individuals discarded are produced by crossing from the remaining individuals. The processing in the step 104 to 106 is performed.

When all the individuals satisfy the constraint conditions by repeating the processing in the steps 104 to 106 (YES in step 106), it is judged whether or not alternation of generations is carried out a predetermined number of times, for example, 300 times (step 107). When the alternation of generations is not performed a predetermined number of times, the program is returned to the step 102, after which the processing in the step 102 and the subsequent steps is performed again.

When it is judged in the step 107 that the alternation of generations is carried out a predetermined number of times, the processing is terminated.

Two individuals having large distance scales R are selected out of the remaining individuals. Masks corresponding to the selected two individuals are produced. One of the masks is taken as a first mask, and the other mask is taken as a second mask.

Although in the above-mentioned second precise judgment processing, matching processing in two steps is performed using the two masks, matching processing in three or more steps may be performed using three or more masks. Alternatively, matching processing in only one step may be performed using one mask.

Although in the above-mentioned embodiment, the first precise judgment processing is performed on the basis of the input waveform based on infrared light, and the second precise judgment processing is performed on the basis of the input waveform based on red light, the first precise judgment processing may be performed on the basis of the input waveform based on red light, and the second precise judgment processing may be performed on the basis of the input waveform based on infrared light. Further, the first precise judgment processing and the second precise judgment processing may be performed on the basis of the input waveform based on infrared light. Alternatively, both the firs precise judgment processing and the second precise judgment processing may be performed on the basis of the input waveform based on red light.

Industrial Applicability

A method of judging the truth of a paper type and a method of judging the direction in which a paper type is fed are useful in judging the truth of a fed bill in money changing machines, various types of automatic vending machines, and the like.

What is claimed is:

1. A method of judging the direction in which a paper type is fed, comprising:

a first step of reading, from a plurality of portions of a paper type to be examined which is put into an examining device, characteristic amounts of the paper type; and a second step of judging the direction in which the paper type is fed by comparing the read characteristic amounts and reference data for each direction of feeding which is previously generated for the direction of feeding; and finding for each reference data for each direction of feeding the sum of the squares of the differences between the characteristic amounts read from the plurality of portions of said paper type and data representing corresponding positions in the reference data for the direction of feeding, and judging that the direction of the reference data corresponding to the minimum value out of the obtained values is said direction in which the paper type is fed.

2. The method of judging the direction in which a paper type is fed, comprising:

a first step of reading, from a plurality of portions of a paper type to be examined which is put into an examining device, characteristic amounts of the paper type; and a second step of judging the direction in which the paper type is fed by comparing the read characteristic amounts and reference data for each direction of feeding which is previously generated for the direction of feeding;

wherein said second step further comprises the steps of finding the differences between characteristic amounts corresponding to positions represented by the characteristic amounts read from the portions for reading of the paper type to be examined and data representing corresponding positions in the reference data for a predetermined direction of feeding and correcting the characteristic amounts for the portions for reading of the paper type so that the average value of the differences becomes zero, finding for each reference data for each direction of feeding the sum of the squares of the differences between characteristic amounts after the correction corresponding to the plurality of portions of said paper type and data representing corresponding positions of the reference data for the direction of feeding, and judging that the direction of the reference data corresponding to the minimum value out of the obtained values is said direction in which the paper type is fed.

3. The method of judging the direction in which a paper type is fed, comprising:

a first step of reading, from a plurality of portions of a paper type to be examined which is put into an examining device, characteristic amounts of the paper type; and a second step of judging the direction in which the paper type is fed by comparing the read characteristic amounts and reference data for each direction of feeding which is previously generated for the direction of feeding, wherein said second step further comprises the steps of retrieving from a plurality of predetermined portions where characteristic amounts are read a minimum of portions for reading where the rate of correct answers to the results of the judgment of the direction of feeding is not less than a threshold by optimization processing using a genetic algorithm, and judging, on the basis of the characteristic amounts obtained only from the retrieved portions where characteristic amounts are read and reference data for each direction in which an object to be examined is fed which is previously generated for the direction of feeding, the direction in which the object to be examined is fed.

4. The method according to claim 3, wherein the optimization processing using the genetic algorithm comprises a first step of producing an initial population comprising a first predetermined number of individuals each having as genes a plurality of predetermined positions where characteristic amounts are read, each of the genes taking a value indicating whether or not the position where a characteristic amount is read for judging the direction of feeding is taken as an object, a second step of selecting from the initial population a second predetermined number of individuals each having a small number of genes taking as an object the position where a characteristic amount is read for judging the direction of feeding, a third step of selecting an arbitrary pair of individuals from the selected individuals and subjecting the pair of individuals to a predetermined genetic operation, to generate a new population comprising a first predetermined number of individuals, a fourth step of calculating for each individual in the new population the rates of corrected answers to the results of the judgment of the direction of feeding which respectively correspond to a plurality of data for examining constraint conditions obtained from a plurality of data for analysis previously prepared, and discarding the individuals the rates of corrected answers of which are lower than a threshold, a fifth step of repeating the predetermined genetic operation, to produce a population comprising the first predetermined number of individuals the rates of corrected answers of which are not less than the threshold, and a sixth step of repeating the processing in the second step to the fifth step a predetermined number of times.

5. The method according to claim 4, wherein the genetic operation is crossing processing and mutation processing.

* * * * *